US007384038B2

(12) United States Patent
Murai

(10) Patent No.: US 7,384,038 B2
(45) Date of Patent: Jun. 10, 2008

(54) SHEET TRANSPORT DEVICE

(75) Inventor: Shunji Murai, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 428 days.

(21) Appl. No.: 11/178,684

(22) Filed: Jul. 12, 2005

(65) Prior Publication Data

US 2007/0013125 A1 Jan. 18, 2007

(51) Int. Cl.
*B65H 31/00* (2006.01)

(52) U.S. Cl. ..... 271/207; 271/213; 358/498; 358/474

(58) Field of Classification Search ..... 271/207, 271/213; 399/108, 125; 358/498, 474
See application file for complete search history.

(56) References Cited

U.S. PATENT DOCUMENTS

| | | | | |
|---|---|---|---|---|
| 5,241,353 | A * | 8/1993 | Maeshima et al. | 399/405 |
| 6,409,166 | B1 * | 6/2002 | Kashimura | 271/213 |
| 6,428,000 | B1 * | 8/2002 | Hara et al. | 271/223 |
| 6,714,326 | B1 * | 3/2004 | Yamada | 358/498 |
| 7,073,787 | B2 * | 7/2006 | Kinsley et al. | 271/162 |

FOREIGN PATENT DOCUMENTS

| | | |
|---|---|---|
| JP | 10-167547 | 6/1998 |
| JP | 2002-002975 | 1/2002 |
| JP | 2003-201054 | 7/2003 |

* cited by examiner

*Primary Examiner*—Kaitlin Joerger
(74) *Attorney, Agent, or Firm*—Banner & Witcoff, Ltd.

(57) ABSTRACT

A sheet transport device according to this invention is provided with: a sheet tray on which a sheet to be transported is placed; a device main body provided with a transport path led from the sheet tray to a discharge outlet; a transport mechanism for transporting the sheet from the sheet tray to the discharge outlet via the transport path; shafts projecting from positions in the vicinity of opposite ends of the discharge outlet of the device main body to horizontal directions opposite to each other; a discharge tray having a main tray which retains the discharged sheet and is provided with bearings for the shafts; and locking members provided in the vicinity of the shafts of the device main body. The locking members lock the shafts of the discharge tray in the bending posture. This locking prevents the discharge tray in the bending posture from coming off the device main body. The locking members allow the bearings of the discharge tray in the bending posture to move toward the front ends of the shafts. The bearings come off the shafts when a load larger than a predetermined one is applied on the main tray.

10 Claims, 14 Drawing Sheets

SHEET TRANSPORT DEVICE

BACKGROUND OF THE INVENTION

1. Field of the Invention

The present invention relates to a sheet transport device transporting a sheet via a predetermined transport path. This invention is applicable particularly to an image reading apparatus such as a facsimile and photocopier; however, its application is not limited to the above cases, and the invention is useful for other types of apparatuses.

2. Description of the Related Art

The sheet transport device transports a sheet from a sheet tray to a discharge tray via a transport path. The discharge tray is attached to a main body of the sheet transport device with a hinge member for the purpose of downsizing the device. The discharge tray is bent toward the device main body when the sheet transport device is not in use and is so opened as to retain the sheet when using the sheet transport device.

A sheet tray wherein an auxiliary tray is coupled rotatably thereto with a hinge member which is formed of a projection member made from an elastic material and a bearing has been known. The auxiliary tray comes off the sheet tray because of elastic deformation of the projection member when an impact or a load larger than a bearable load is applied on the auxiliary tray. Therefore, the auxiliary tray is not damaged even when impact or load larger than the bearable load is applied on the auxiliary tray. Also, the projection member returns to its original shape without being damaged. The auxiliary tray is attached again to the sheet tray by the use of the projection member.

A sheet tray provided with an extension tray which is rotatable about a main tray has been known. When the extension tray is opened, it is possible to house a sheet having a size larger than the main tray. The sheet tray is compact in size when the extension tray is closed.

A sheet feeding device feeding a recording paper placed on a sheet tray to an image forming device through a sheet feed opening, which is provided with a cover member rotating in such a fashion as to open and close the sheet feed opening has been known. The cover member prevents entry of contaminants through the sheet feed opening.

The above technologies are disclosed in JP-A-10-167547 published on Jun. 23, 1998, JP-A-2003-201054 published on Jul. 15, 2003, and JP-A-2002-2975 published on Jan. 9, 2002.

A footprint of the sheet transport device is reduced when the discharge tray is capable of opening/closing and closed in such a fashion as not to project from the device when the device is not in use. The discharge tray is prevented from being damaged when the discharge tray is capable of coming off the device main body when an excessive force is applied on the discharge tray. The discharge tray may come off by an external force when the discharge tray is closed. However, when the discharge tray is closed, it is unlikely that the discharge tray will be damaged. It is undesirable that the discharge tray comes off when the discharge tray is closed.

An opening other than the sheet feed opening connecting to an internal portion of the device is formed on a housing of the sheet transport device for various purposes. Contaminants may enter the internal portion of the device through the opening. Particularly, if the contaminants are fallen on a control substrate, an electrical failure can be caused by the contaminants. Various electrical wirings are connected to the control substrate. In view of assembly of the wirings and the like, it is undesirable to cover the control substrate with a cover before finishing the wirings.

SUMMARY OF THE INVENTION

This invention has been accomplished in view of the above-described background. An object of this invention is to provide a sheet transport device wherein a discharge tray comes off when a load of sheets or a load by impact which is larger than a bearable load of the discharge tray is applied on the discharge tray in a retention posture, and the discharge tray never comes off when the discharge tray is in a bending posture.

Another object of this invention is to prevent contaminants entering an internal portion of the device through an opening formed on a housing of the device from falling on a control substrate.

These and other objects of this invention and an effect of this invention will become apparent from the following detailed description.

(1) A sheet transport device according to this invention comprises: a sheet tray on which a sheet to be transported is placed; a device main body provided with a transport path led from the sheet tray to a discharge outlet; a transport mechanism for transporting the sheet from the sheet tray to the discharge outlet via the transport path; shafts projecting from positions in the vicinity of opposite ends of the discharge outlet of the device main body to horizontal directions opposite to each other; a discharge tray having a main tray which retains the discharged sheet and is provided with bearings for the shafts; and locking members provided in the vicinity of the shafts of the device main body.

Each of the bearings of the discharge tray is fitted to the relevant one of the shafts of the device main body. Because of the fitting of the bearings to the shafts, the discharge tray changes its posture between a bending posture wherein a main tray is bent to the device main body and a retention posture wherein the main tray projects from the device main body to retain the sheet discharged from the discharge outlet.

The discharge tray is capable of elastic deformation in such a fashion that each of the bearings moves toward a front end of the relevant shaft. For instance, a load is applied on the main tray when plural sheets are retained in the main tray of the discharge tray in the retention posture. The load is transmitted to the shafts of the device main body via the bearings. The discharge tray is capable of elastic deformation in such a fashion that each of the bearings moves toward a front end of the relevant shaft. The discharge tray is deformed elastically when the load is applied on the main tray so that the bearings move toward the front ends of the shafts.

The locking members lock the bearings of the discharge tray in the bending posture. This locking restrains the bearings from moving toward the front ends of the shafts even when the discharge tray elastically deforms due to a certain external force applied on the discharge tray. Because the movements of the bearings are thus restrained, the discharge tray does not come off the device main body in the bending posture. The locking members allow the bearings of the discharge tray in the retention posture to move toward the front ends of the shafts. As described in the foregoing, the bearings move toward the front ends of the shafts when the load is applied on the main tray of the discharge tray in the retention posture because of the elastic deformation of the discharge tray. With an increase in load applied on the main tray, the movements of the bearings are increased. When a load larger than a predetermined one is applied on the main tray, the bearings come off the shafts, i.e. the discharge tray comes off the device main body.

(2) Each of the shafts may preferably be reduced in diameter to its front end in a tapered fashion. When the load is applied on the main tray of the discharge tray in the retention posture, the load is transmitted to the shafts of the device main body via the bearings. Since each of the shafts is reduced in diameter to the front end in tapered fashion, the bearing moves toward the front end in such a manner as to slide down the shaft. Thus, the bearings move readily toward the front ends of the shafts in accordance with the load applied on the main tray.

(3) The discharge tray may preferably retain the sheet on a top face of the main tray when the discharge tray is in the retention posture. Each of the bearings may preferably be provided with a projection piece projecting in a direction upward from the top face of the main tray and having a shaft hole.

(4) Each of the locking members may preferably project in a direction approaching to the shaft at a position closer to the front end of the shaft than to the bearing fitted to the shaft. The projection piece of each of the bearings may be provided with a locking rib. The locking rib extends in such a fashion that an outer rim thereof is situated outside an edge of the locking member in a radial direction of the shaft when the discharge tray is in the bending posture and that the outer rim is situated inside the edge of the locking member in the radial direction of the shaft when the discharge tray is in the retention posture.

(5) The locking rib may be formed on one of the bearings of the discharge tray. With at least one of the bearings being provided with the locking rib, the bearing never comes off the shaft when the discharge tray is in the bending posture. That is, the discharge tray does not come off the device main body completely.

(6) The discharge tray may preferably project in a horizontal direction from a position in the vicinity of the discharge outlet of the device main body in the retention posture.

(7) The discharge tray may preferably cover an operation panel provided on the device main body in the bending posture. With the operation panel covered with the discharge tray, inadvertent input to the operation panel is prevented when the device is not used.

(8) The operation panel may be provided with a liquid crystal display unit. The discharge tray may be provided with a window for making the liquid crystal display unit visible when the discharge tray is in the bending posture. Contents displayed on the liquid crystal display unit are confirmed through the window when the discharge tray is in the bending posture.

(9) The window of the discharge tray may be provided with a transparent member. Due to the transparent member, contents displayed on the liquid crystal display unit are confirmed when the discharge tray is in the bending posture. Further, unwanted contact onto the liquid crystal display unit is prevented.

(10) The discharge tray may be provided with an extension tray capable of moving in and out of the main tray. The extension tray changes its posture between an extension posture for projecting from an end of the main tray and a housing posture for being housed in the main tray. When the extension tray is in the extension posture, an area for retaining the sheet on the extension tray is added to the area for retaining the sheet by a main tray. Due to the extension tray, the discharge tray retains a sheet having a larger size. When the extension tray is in the housing posture, a size of the discharge tray is reduced.

(11) As described in the foregoing, according to this invention, the bearings move a distance longer than a length of the shafts to cause the discharge tray to come off the device main body when the load of sheet, the load of impact, or the like larger than the predetermined degree is applied on the discharge tray in the retention posture. Because the discharge tray thus comes of f the device main body, the bearings and the shafts are prevented from being damaged when the load larger than a bearable load is applied on the discharge tray. In the bending posture, the locking members lock the bearings to restrain the bearings to move in the shaft direction. Because the bearings are thus restrained, the discharge tray is prevented from coming off the device main body.

DESCRIPTION OF THE PREFERRED EMBODIMENTS

Hereinafter, this invention will be described in detail with reference to the drawings and based on preferred embodiments.

(Overall Structure)

Figure 1:
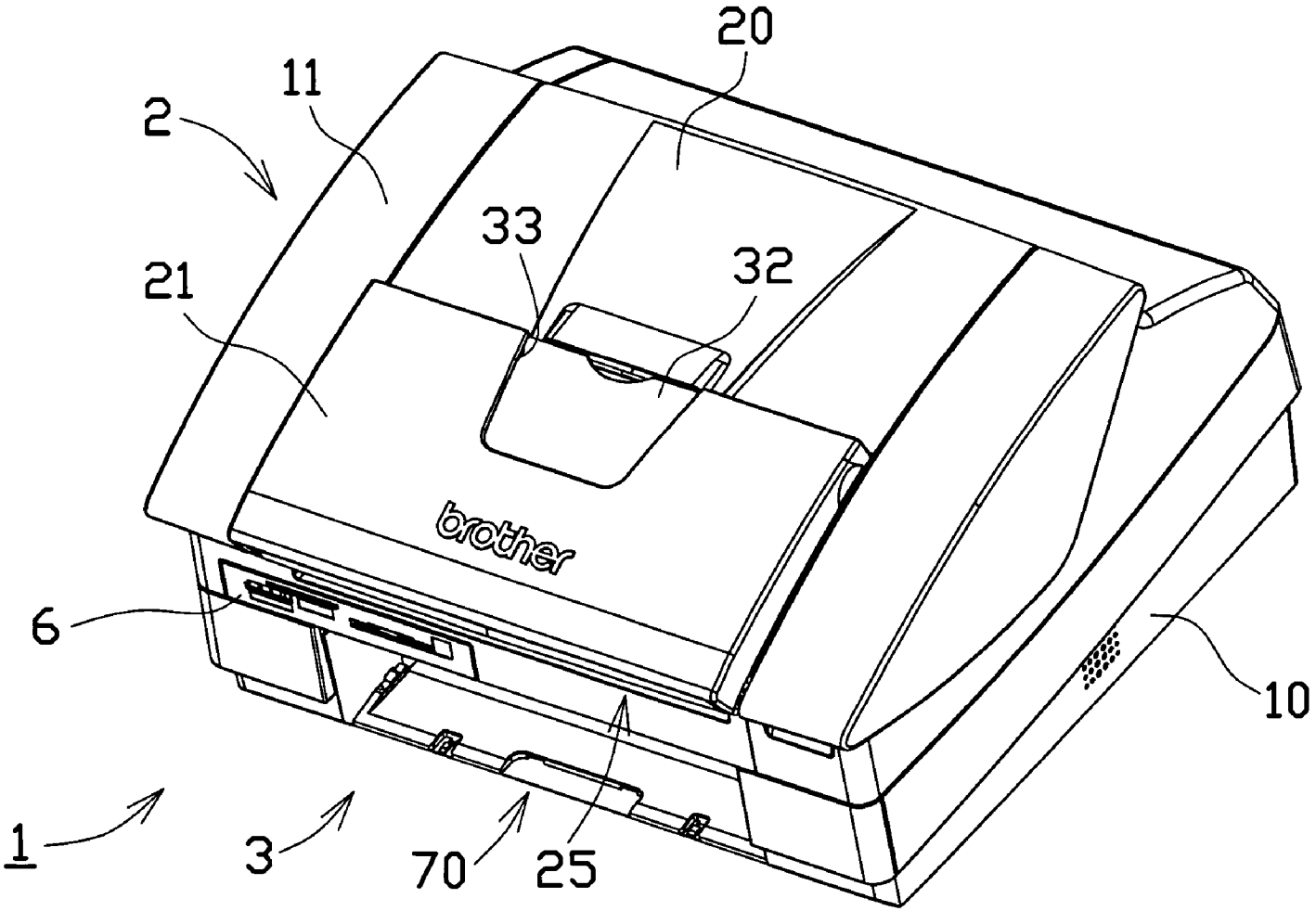
FIG. 1 is a perspective view showing a multifunction device 1 according to one embodiment of this invention.

FIG. 1 is a diagram showing an appearance of a multifunction device 1 according to one embodiment of this invention. The multifunction device 1 have a scanner function, a printer function, and a facsimile function in an integral fashion. The multifunction device 1 can be divided roughly into 2 units according to the functions which are an upper unit and a lower unit. The upper unit of the multifunction device 1 is a scanner unit 2 for reading an image of a document. The lower unit of the multifunction device 1 is a printer unit 3 for recording the image on a recording paper. The sheet transport device according to this invention is mounted on the scanner unit 2 of the multifunction device 1. A structure of the multifunction device 1 to be described in detail below is one example of the sheet transport device according to this invention. It is possible to modify the structure of the multifunction device 1 as required so far as the modification does not depart from the scope of this invention. According to this embodiment, the sheet transport device according to this invention is applied the scanner unit 2, however, the sheet transport device according to this invention is not limited thereto. For example, this invention may also be applied to an image forming device for forming an image on a recording paper.

The multifunction device 1 is connected principally to a computer (external information appliance) which is not shown. Image data of the document read by the scanner unit 2 are transmitted to the computer. In the case of using the multifunction device 1 as a facsimile, image data read by the scanner unit 2 are transmitted by telephotography to a telephone line via a facsimile modem. The printer unit 3 records an image and/or a text on a recording paper based on print data including the image data and/or the text data transmitted from the computer. It is possible to connect the multifunction device 1 to an external appliance such as a digital camera. When the multifunction device 1 is connected to a digital camera, the printer unit 3 records an image on a recording paper based on image data output from the digital camera. It is possible to insert various information storage mediums such as a memory card into the multifunction device 1. When a information storage medium is inserted into the multifunction device 1, the printer unit 3 records an image on a recording paper based on image data or the like recorded on the information storage medium. Also, facsimile data received by the multifunction device 1 via a telephone line are recorded on a recording paper by the printer unit 3.

Figure 2:
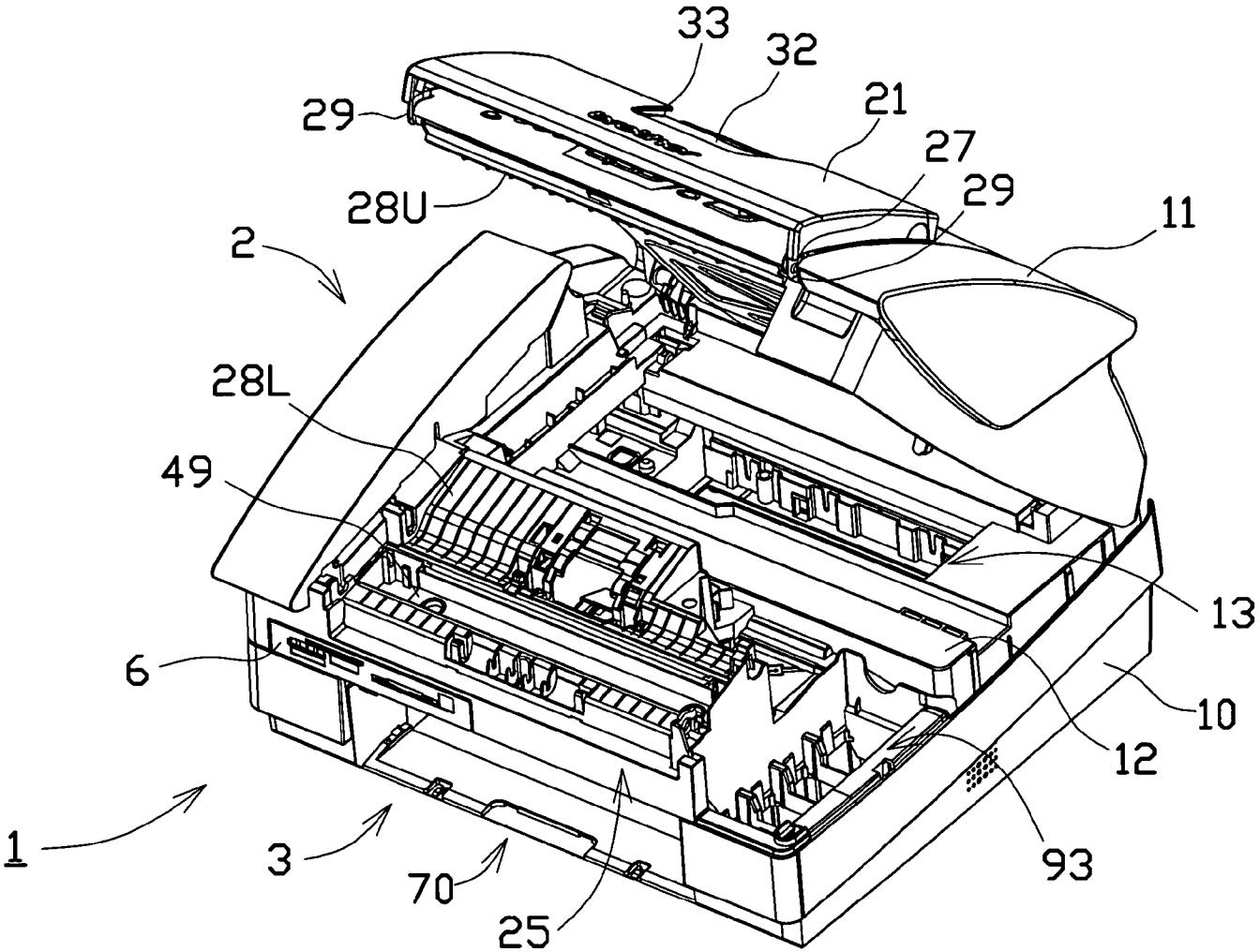
FIG. 2 is a perspective view showing the multifunction device 1 wherein a top cover 11 is opened.

As shown in FIGS. 1 and 2, a main frame 10 and a top cover 11 form a housing of the multifunction device 1. The main frame 10 is a housing of a lower part of the multifunction device 1 and mainly forms a housing of the printer unit 3. The top cover 11 is a housing of an upper part of the multifunction device 1 and mainly forms a housing of the scanner unit 2.

As shown in FIG. 2, the top cover 11 is supported by an intermediate frame 12 at a rear part of the device by a hinge structure. The top cover 11 is capable of opening and closing in such a fashion as to rotate upward from the intermediate frame 12. The intermediate frame 12 covers the upper part of the printer unit 3 and forms a part of the scanner unit 2. The top cover 11 and the intermediate frame 12 form a main part (main body) of the scanner unit 2.

As shown in FIG. 2, an interior portion of the scanner unit 2 is exposed when the top cover 11 is opened. It is possible to perform maintenance work in the scanner unit 2, such as paper jam release, when the top cover 11 is opened. An opening 13 is formed on at the rear of the intermediate frame 12. A part of the printer unit 3 is exposed through the opening 13. A right corner on a front face side of the intermediate frame 12 is notched off. An ink cartridge mounting unit 93 of the printer unit 3 is exposed at the right corner. It is possible to perform maintenance work in the printer unit 3, such as paper jam release and ink cartridge replacement, when the top cover 11 is opened.

Figure 3:
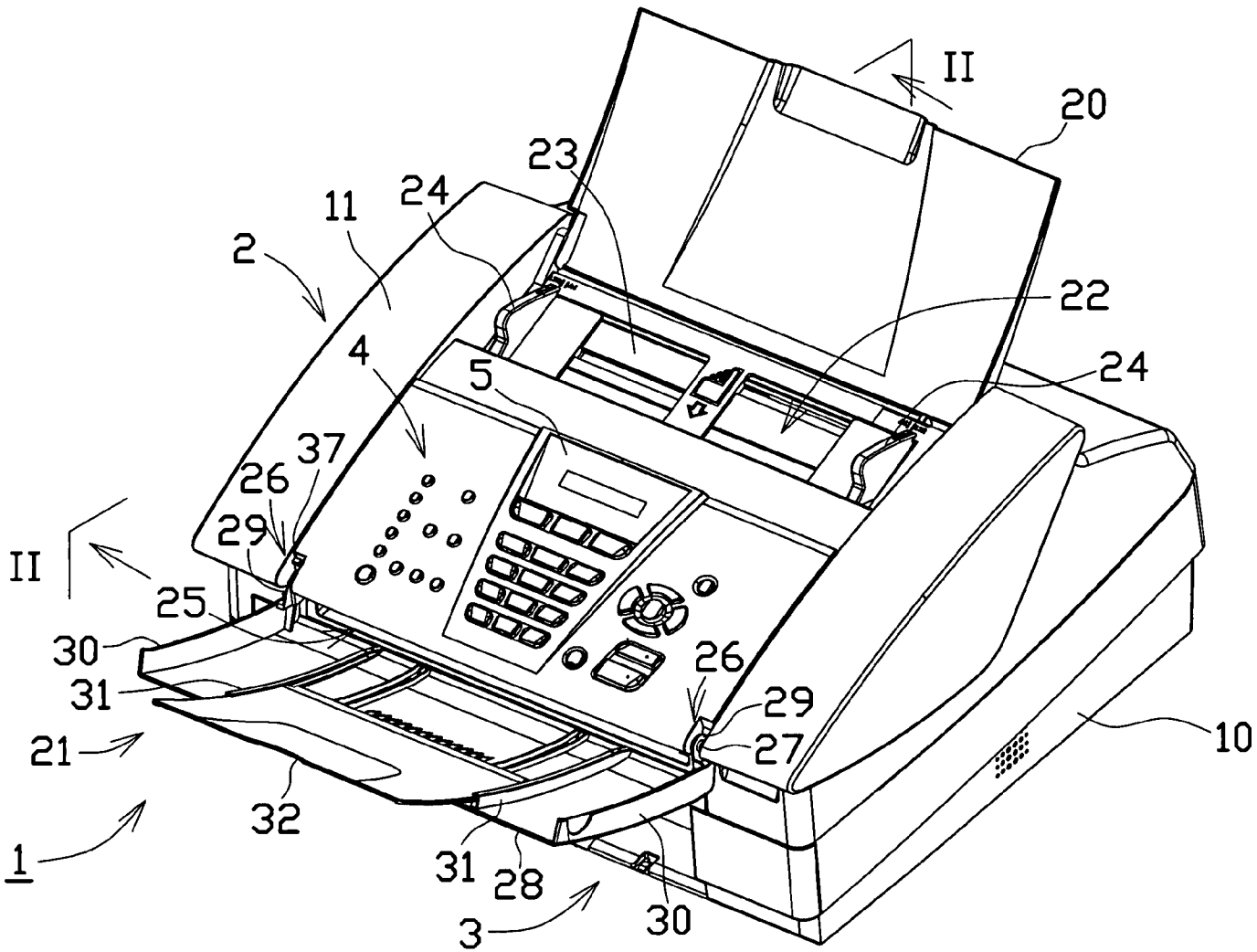
FIG. 3 is a perspective view showing the multifunction device 1 wherein a document guide 20 and a discharge tray 21 are opened.

As shown in FIGS. 1 and 3, the top cover 11 is provided with a document guide 20 and a discharge tray 21. The document guide 20 is rotatably provided on a rear part of a top face of the top cover 11. The discharge tray 21 is rotatably provided on a front part of the top cover 11. Detailed descriptions of structures of these components will be given later in this specification.

An operation panel 4 (input unit) is provided on the top face of the top cover 11. The operation panel 4 is exposed when the discharger tray 21 is opened as shown in FIG. 3. The operation panel 4 is provided with various operation buttons and a liquid crystal display 5 (liquid crystal display unit). The operation buttons include, for example, a power button for switching on and off power of the multifunction device 1, a start button for starting an operation of the scanner unit 2 or the printer unit 3, a stop button for stopping an operation and terminating a setting up operation, a mode button for selecting a function such as a scanner function, a copy function, and a facsimile function, a dial button used for dialing, various setting buttons, and the like. A predetermined input is added to a controller of the multifunction device 1 when a predetermined one of the buttons of the operation panel 4 is pressed down. A current status of the multifunction device 1, an operation guide to a user, and the like are displayed on the liquid crystal display 5. The multifunction device 1 is operated by the controller based on the input to the operation panel 4. When the multifunction device 1 is connected to a computer, the multifunction device 1 is operated based also on instructions transmitted via a printer driver or a scanner driver.

A card slot unit 6 is provided at a left hand side of a front face of the multifunction device 1. It is possible to insert a small size memory card which is a information storage medium in the card slot unit 6. Various slots are formed in accordance with various different standards in the card slot unit 6 so that various different small size memory cards can be inserted into the card slot unit 6. Image data recorded on the small size memory card inserted into the card slot unit 6 are read out by the controller of the multifunction device 1. Information relating to the read out image data is displayed on the liquid crystal display 5. Arbitrary image data among the image data recorded on the small size memory card are recorded on a recording paper by the printer unit 3 based on an input to the operation panel 4.

(Structure of Scanner Unit 2)

Hereinafter, a structure of the scanner unit 2 will be described in detail. The scanner unit 2 is of a sheet-feed type which is capable of reading an image of a document(sheet) in the course of a transport of the document from a document chute 22 (sheet tray) to a discharge tray 21. Such document transport is realized by the sheet transport device according to this invention.

As shown in FIG. 3, the document chute 22 is formed on the top cover 11. The center at the rear part of the top face of the top cover 11 is recessed and opened toward the rear side to form the document chute 22. The document chute 22 has a width which is a little wider than a maximum document width readable by the scanner unit 2. A document to be read by the scanner unit 2 is placed on the document chute 22. The document placed on the document chute 22 is fed to a transport path (see FIG. 9).

The document chute 22 is provided with the document guide 20 which opens and closes by using the rear side as a supporting point. The document guide 20 is provided rotatably on the top cover 11 by way of the hinge structure. As shown in FIG. 3, an inner surface of the document guide 20 is extended from a document tray face 23 of the document chute 22 when the document guide 20 is opened. The document guide 20 and the document chute 22 form the sheet tray according to this invention. As shown in FIG. 1, the document chute 22 is covered with the document guide 20 when the document guide 20 is closed. The document guide 20 prevents entry of contaminants and dust into an interior portion of the device through the opening of the document chute 22.

As shown in FIG. 3, the document chute 22 has a pair of width guides 24. The width guides 24 project upward from the document tray face 23. The width guides 24 are capable of slidably moving in a device width direction, i.e., in a direction perpendicular to a direction in which the document is transferred. The sliding movements of the width guides 24 are interlocked with each other. For instance, when one of the width guides 24 is slidably moved toward the center of the device, the other width guide 24 slidably moves toward the center of the device interlockingly with the sliding movement of the former width guide 24. A distance between the width guides 24 is adjusted to match a desired document width so that both ends of the document are guided by the width guides 24.

A discharge outlet 25 is formed on the front face of the top cover 11. The discharge outlet 25 has a width which is a little wider than the maximum document width readable by the scanner unit 2. The document is discharged from the discharge outlet 25 after being transferred on a transport path 38 (see FIG. 9). A notch 26 is formed at a position which is a little outside of each of ends of the discharge outlet 25 on the front face of the top cover 11. In each of the notches 26, a shaft 27 is projected in a horizontal direction. Each of the shafts 27 projects from an interior face of the notch 26 toward the outside of the device. That is, the projection directions of the shafts 27 are horizontally opposite to each other.

The discharge tray 21 has a flat main tray 28 and bearings 29. The main tray 28 is used for holding the document after being read. The main tray 28 has a width which is a little wider than the maximum document width readable by the scanner unit 2. The main tray width is wider than the width of the discharge outlet 25. A document stopper rib 30 is formed at each of side rims of the main tray 28 in such a fashion as to project upward. The document stopper ribs 30 prevent the document discharged on the main tray 28 from being falling down from the sides of the main tray 28.

The bearings 29 are provided at ends of a rear edge of the discharge tray 21. The bearings 29 are fitted to the shafts 27 of the top cover 11. Because of the fitting of the shafts 27 and the bearings 29, the discharge tray 21 is rotatable about the shafts 27. As shown in FIG. 3, the discharge tray 21 takes a posture wherein the top face of the main tray 28 is substantially horizontal under the discharge outlet 25 when a periphery at the rear edge of the discharge tray 21 is brought into abutting contact with the top cover 11 or the intermediate frame 12. In other words, when the discharge tray 21 is in a stationary state, the discharge tray 21 takes a posture wherein the discharge tray 21 projects from under the discharge outlet 25 in the horizontal direction. This state is referred to as a retention posture in this invention. The discharge tray 21 is taken the retention posture when the scanner unit 2 is used. The discharge tray 21 taking the retention posture retains the document discharged from the discharge outlet 25 on the top face of the main tray 28.

Figure 5:
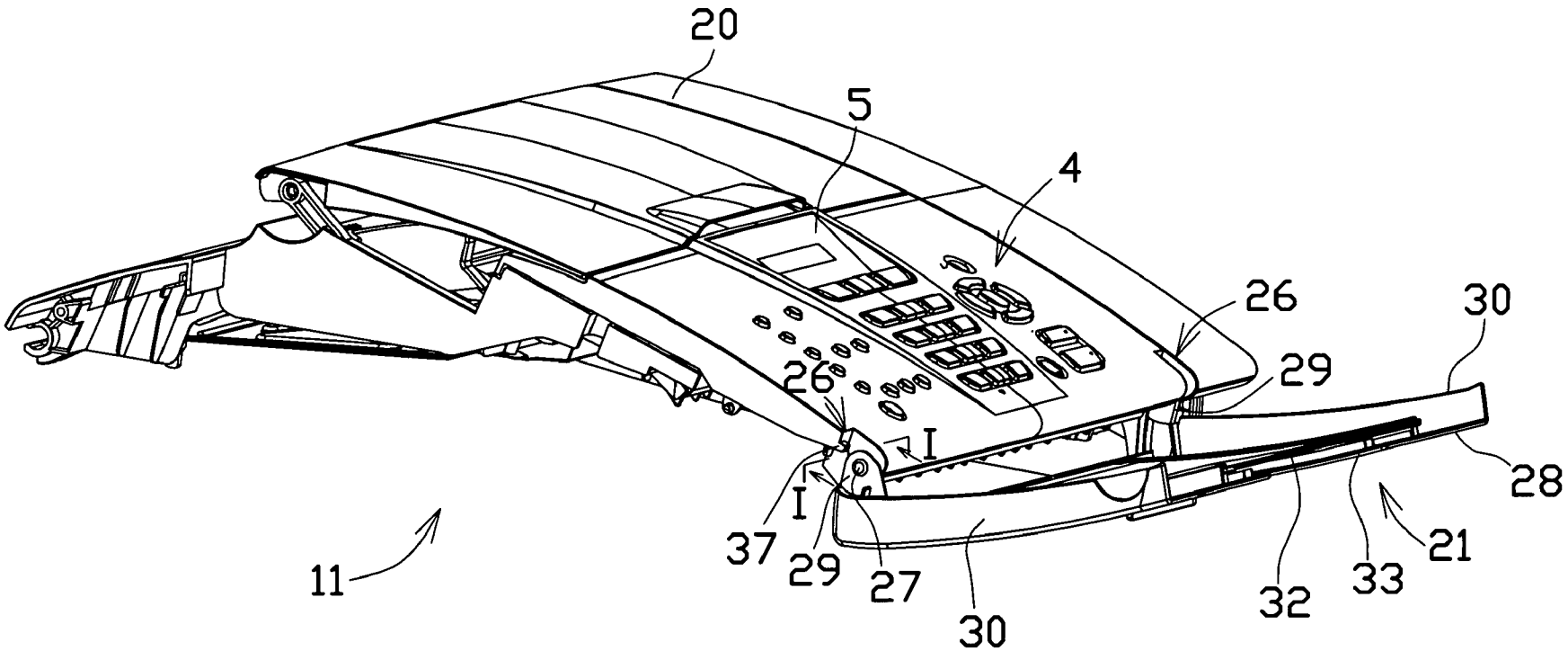
FIG. 5 is a perspective view showing the top cover 11 when the discharge tray 21 is in a retention posture.

A pair of guide ribs 31 is formed on the top face of the main tray 28 along a direction of document discharge. Guide grooves are formed on opposed faces of the guide ribs 31. An extension tray 32 is provided in such a fashion as to be held between the guide ribs 31. The extension tray 32 is capable of slidably moving with being guided by the guide ribs 31. The extension tray 32 slidably moves to appear from a front edge of the main tray 28. In other words, the extension tray 32 changes its posture between an extension posture wherein the extension tray 32 projects from the front edge of the main tray 28 in the document discharge direction and a housing posture wherein the extension tray 32 is housed in the main tray 28. Shown in FIG. 3 is the extension tray 32 in the extension posture. Because of the extension tray 32 in the extension posture, an area for retaining the document on the extension tray 32 is added to an area for retaining the document by the main tray 28. The area added by the extension tray 32 enables the discharge tray 21 to retain a document having a size larger than a size of the main tray 28. The extension tray 32 is kept in the housing posture when it is not used. The extension tray 32 in the housing posture is housed inside the main tray 28 as shown in FIG. 5 to reduce the size of the discharge tray 21.

As shown in FIG. 1, the discharge tray 21 is rotated about the shafts 27 to be bent onto the top face of the top cover 11. The thus-bent discharge tray 21 covers the various operation buttons and the liquid crystal display 5 of the operation panel 4. This state is referred to as a bending posture in this invention. The discharge tray 21 may preferably be in the bending posture when the scanner unit 2 is not used. Since the operation panel 4 is disposed on the top face of the top cover, the user can inadvertently touches the buttons of the operation panel 4. With the operation panel 4 covered with the discharge tray 21, it is possible to prevent such inadvertent input to the operation panel 4 when the scanner unit 2 is not used.

As shown in FIG. 1, a window 33 is formed by notching off the center of the discharge tray 21 near its front edge. The window 33 has a size corresponding to the liquid crystal display 5 of the operation panel 4. The extension tray 32 is exposed because of the window 33. The extension tray 32 is made from a material having transparency. Because of the transparency of the extension tray 32, it is possible to visually confirm the display on the liquid crystal display 5 through the extension tray 32. That is, the display on the liquid crystal display 5 is visually confirmed through the window 33 when the discharge tray 21 is in the bending posture. Also, the extension tray 32 prevents unwanted contact onto the liquid crystal displays. The unwanted contact is, for example, a contact of a falling object.

Figure 4:
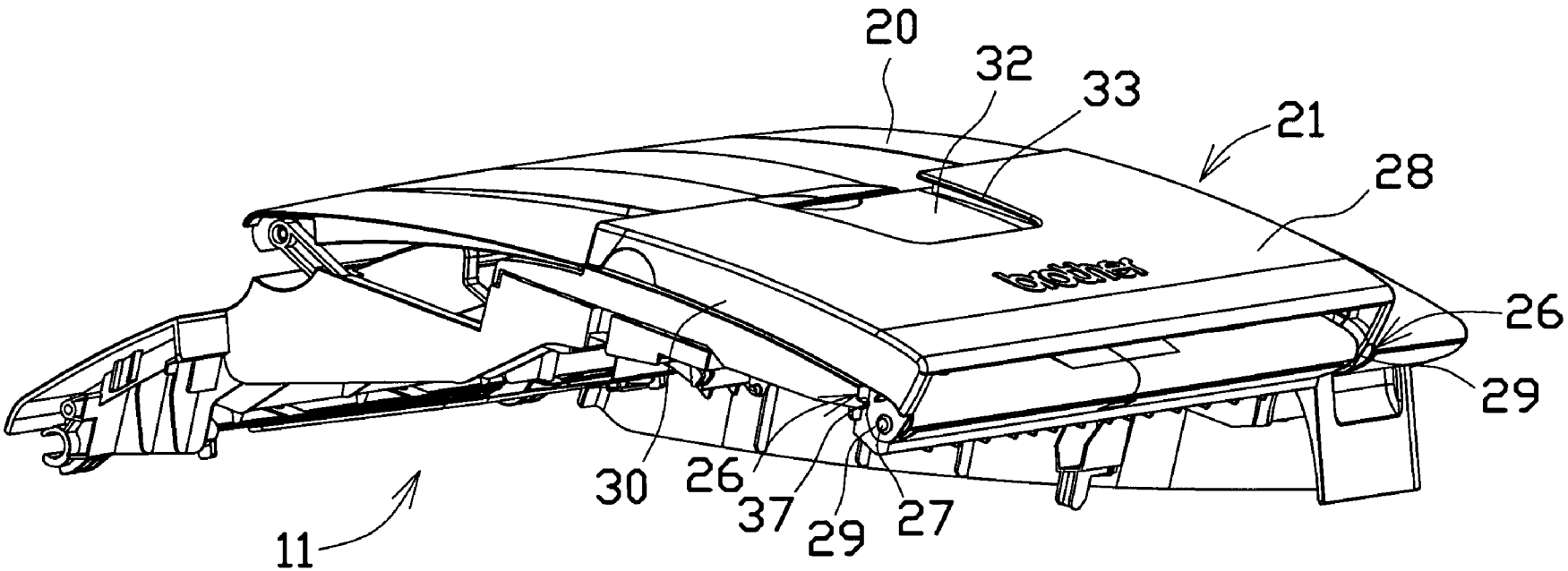
FIG. 4 is a perspective view showing the top cover 11 when a discharge tray 21 is in a bending posture.

Hereinafter, the fitting structure of the top cover 11 and the discharge tray 21 will be described in detail. As shown in FIGS. 4 and 5, the shafts 27 are projected in the horizontal direction on the front part of the top cover 11. As described in the foregoing, the shafts 27 project toward the outside of the device from the interior face of the notches 26 of the top cover 11. The shaft 27 which is on the left hand side as viewed from the front of the device is shown in FIGS. 4 and 5. The bearings 29 of the discharge tray 21 are fitted to the shafts 27. By the fitting of the shafts 27 and the bearings 29, the discharge tray 21 changes its posture between the bending posture and the retention posture when rotated about the shafts 27.

Figure 6:
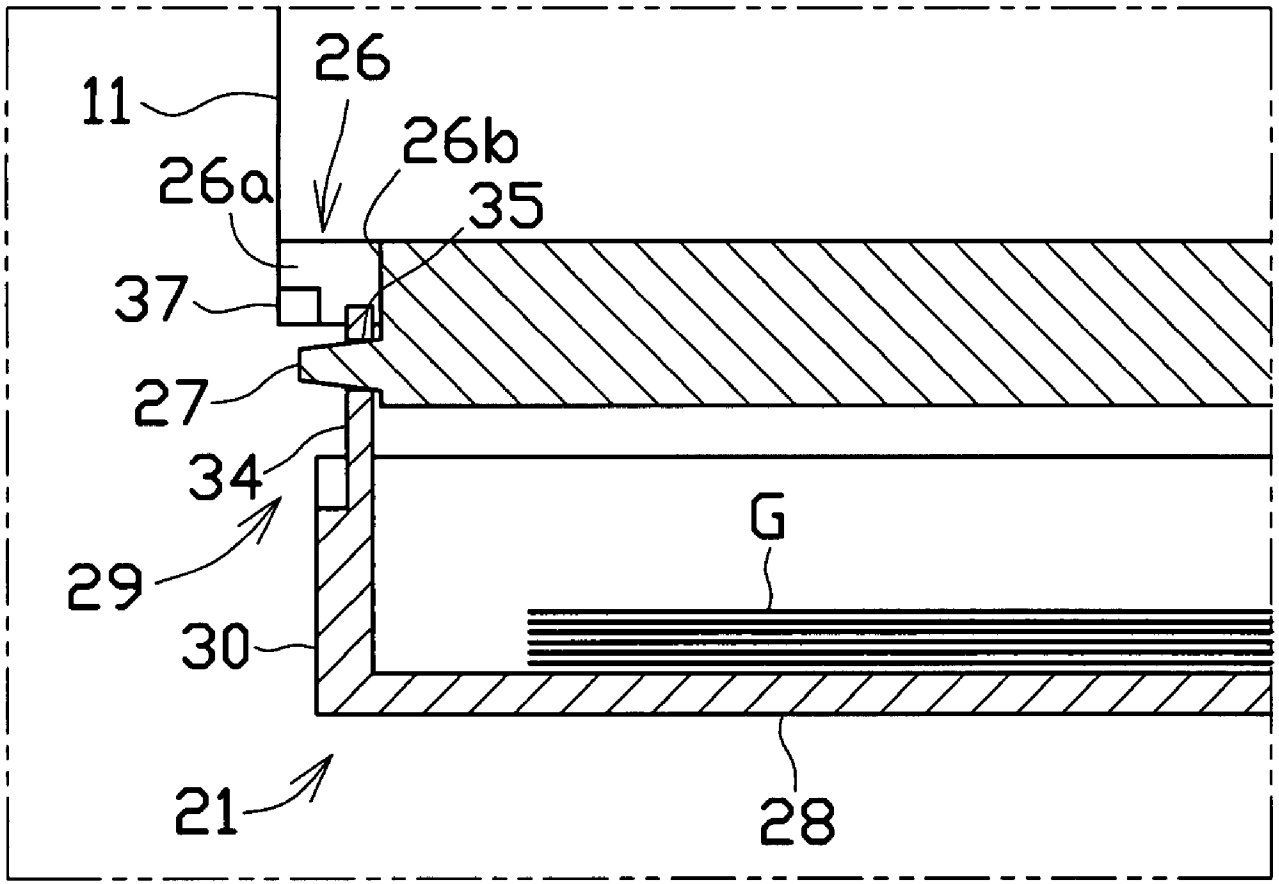
FIG. 6 is a diagram showing a I-I section of FIG. 5.

As shown in FIG. 6, each of the shafts 27 is tapered in such a fashion that a diameter thereof is reduced toward the front end thereof. That is, an outer diameter of the shaft 27 at the front end (left hand side in FIG. 6) is smaller than an outer diameter of the shaft 27 at a rear end (right hand side in FIG. 6: near the top cover 11). Such change in outer diameter is gradual from the rear end to the front end. The gradual reduction in diameter toward the front end of the shaft 27 is referred to as the reduction in diameter in tapered fashion in this invention.

Figure 7:
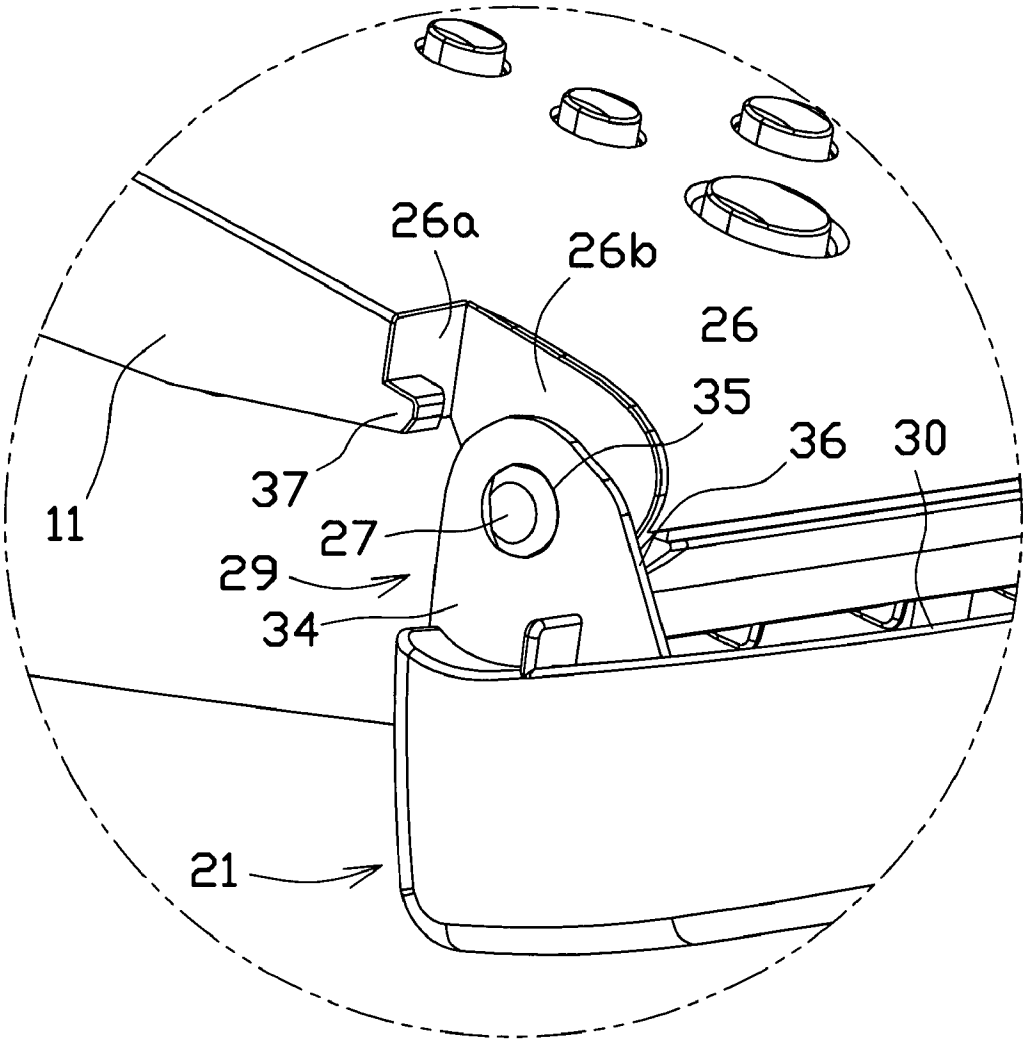
FIG. 7 is an enlarged view of a portion in the vicinity of the bearing 29 shown in FIG. 5.

As shown in FIGS. 6 and 7, a stopper 37 (locking member) is provided in the vicinity of each of the shaft 27 of the top cover 11. More specifically, the stopper 37 is projected from a recessed face 26*a* of the notch 26 toward the shaft 27. The stopper 37 is provided in such a fashion as to form a predetermined gap with the shaft 27. The gap is formed in an axial direction and a radial direction of the shaft 27.

In the axial direction of the shaft 27, the stopper 37 is disposed at a position closer to the front end of the shaft 27 than to a projection piece 34 of the bearing 29 fitted to the shaft 27. In other words, the stopper 37 is disposed outside of the main cover 11 on the recessed face 26*a* of the notch 26. Because of the location of the stopper 37, a space is defined between a side face 26*b* of the notch 26 which is in the interior portion of the main cover 11 and the stopper 37. This space is used for the rotation of the bearing 29 fitted to the shaft 27 near the rear end of the shaft 27.

In the radial direction of the shaft 27, the stopper 37 is projected in a direction approaching from the recessed face 26*a* of the notch 26 to the shaft 27 so as to form a predetermined gap. The gap in the radial direction between the shaft 27 and the stopper 37 is defined by a relationship between the projection piece 34 and the locking rib 36. The relationship will be described later in this specification.

As shown in FIGS. 6 and 7, the main tray 28 of the discharge tray 21 is provided with the bearings 29 corresponding to the shafts 27. Each of the bearings 29 is formed of the projection piece 34 projecting upward from the top face of the main tray 28 in the retention posture and a shaft hole 35 formed on the projection piece 34. The projection pieces 34 are so formed as to extend the document stopper ribs 30 formed on the side rims of the main tray 28. As shown in FIG. 7, each of the projection pieces 34 has a semicircular edge and generally is in the shape of a tongue.

Figure 8:
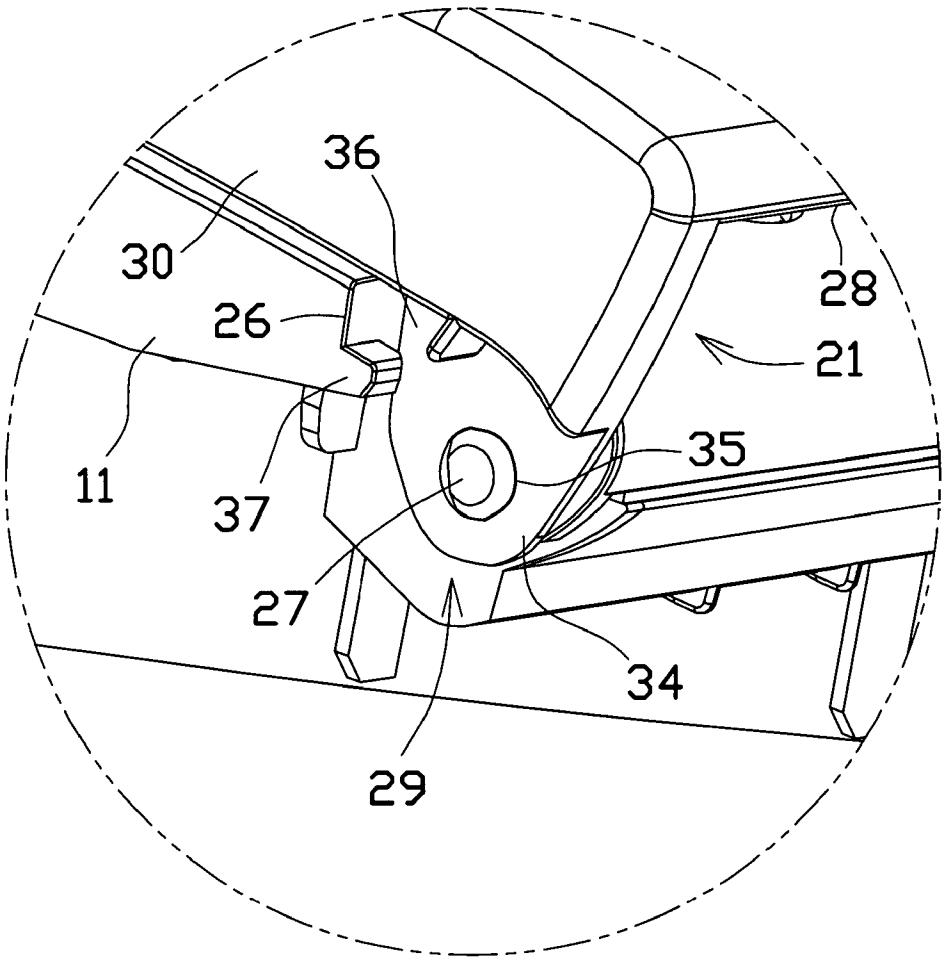
FIG. 8 is an enlarged view of a portion in the vicinity of the baring 29 shown in FIG. 4.

As shown in FIGS. 7 and 8, the locking rib 36 is formed on each of the projection pieces 34. More specifically, the locking rib 36 is formed in such a manner that a front part of a rim of the projection piece 34 of the discharge tray 21 in the retention posture extended outwardly. In other words, the locking rib 36 does not exist at a rear part of the rim of the projection piece 34 of the discharge tray 21 in the retention posture.

As described in the foregoing, the gap is formed between the shaft 27 and the stopper 37 in the radial direction of the shaft 27. In the state where the bearing 29 is fitted to the shaft 27, the gap has the size larger than the projection of the projection piece 34 in the radial direction of the shaft 27. In other words, the stopper 37 dos not contact with the projection piece 34 when the projection piece 34 is fitted to the shaft 27. Or, as shown in FIG. 7, an outer rim of the locking rib 36 is positioned inside the edge of the stopper 37 in the radial direction of the shaft 27 when the discharge tray 21 takes the retention posture. The locking ribs 36 do not contact the stoppers 37 when the discharge tray 21 takes the retention posture.

The gap between the shaft 27 and the stopper 37 has the size smaller than the projection of the locking rib 36 in the radial direction of the shaft 27. In other words, the stopper 37 locks the locking rib 36 when the discharge tray is in the bending posture as shown in FIG. 8. Or, the locking rib 36 is extended in such a fashion that an outer rim thereof is positioned outside the edge of the stopper 37 in the radial direction of the shaft 27. It is possible that the locking ribs 36 are locked by the stoppers 37 when the discharge tray 21 is in the bending posture. In the case where the discharge tray 21 is rotated to change its posture from the retention posture to the bending posture, each of the locking ribs 36 enters the space between the stopper 37 and the side face 26*b* of the notch 26.

In the case where the discharge tray 21 is in the bending posture, the locking ribs 36 are locked by the stoppers 37 in the course of the movement from the rear ends to the front ends of the shafts 27. When the locking ribs 36 are locked by the stoppers 37, the bearings 29 of the discharge tray 21 in the bending posture are inhibited from moving further from the stoppers 37 toward the front ends of the shafts 27. When the stoppers 37 do not lock the locking ribs 36, the bearings 29 of the discharge tray 21 move toward the front ends of the shafts 27. As shown in FIGS. 5 and 7, the stoppers 37 do not contact the projection pieces 34 and the locking ribs 36 when the discharge tray 21 is in the retention posture.

The discharge tray 21 is capable of elastic deformation so that the bearings 29 move toward the front ends of the shafts 27. The discharge tray 21 is a molded article made from a synthetic resin, for example. The discharge tray 21 is elastically deformed by an external force. The external force is a weight of documents retained by the discharge tray 21 or an impact applied on the discharge tray 21, for example. The elastic deformation of the discharge tray 21 occurs mainly in the main tray 28 without limitation thereto. For instance, the bearings 29 are moved toward the front ends of the shafts 27 when the document stopper ribs 30 of the main tray 28 are elastically deformed in such a fashion as to bend outward.

As shown in FIG. 6, the main tray 28 of the discharge tray 21 in the retention posture retains a document G discharged from the discharge outlet 25. The document G has undergone the image reading by the scanner unit 2. When there are plural documents G, the scanner unit 2 sequentially reads images on the documents G. The plural documents G are discharged from the discharge outlet 25 in order of precedence. The discharge tray 21 retains the discharged documents G in such a fashion as to pile the discharged documents G up. With an increase in the number of documents G, a load of the documents G retained by the discharge tray 21 is increased.

When the discharge tray 21 is in the retention posture, the discharge tray 21 is supported by the shafts 27. The load of the documents G piled up on the main tray 28 is transmitted to the shafts 27 via the shaft holes 35 of the projection pieces 34 of the bearings 29. Each of the shafts 27 supports the relevant one of projection pieces 34 at an upper part of its periphery. The shaft 27 is reduced in diameter toward the front end in tapered fashion. The upper part of the periphery of the shaft 27 is so sloped as to descending toward the front end. The load of the documents G is exerted in a vertical direction with respect to the projection piece 34. In view of the slope on the upper part of the shaft 27, the load of the documents G is distributed in directions vertical and horizontal to the slope. The force in the direction horizontal to the slope is the force moving the projection piece 34 towards the front end of the shaft 27. In order to move the projection piece 34 toward the front end of the shaft 27, it is necessary that the discharge tray 21 should be elastically deformed. That is, the force in the direction horizontal to the slope is the force elastically deforming the discharge tray 21.

In the case where the load of the documents G is small, i.e. the number of the documents G is small, it is difficult to elastically deform the discharge tray 21 by a large scale. With the increase in the number of the documents G, the load of the documents G is increased. The force in the direction horizontal to the slope of the shaft 27 is enhanced in proportion to the load. That is, the force for moving the projection piece 34 toward the front end of the shaft 27 by the elastic deformation of the discharge tray 21 is increased in proportion to the load. When the load of the documents G is increased, the projection piece 34 moves by a large scale toward the front end of the shaft 27. When the discharge tray 21 is in the retention posture, each of the locking ribs 36 is not locked by the stopper 37. That is, the stopper 37 allows the movement of the projection piece 34 toward the front end of the shaft 27. When the load by the documents G reaches a predetermined degree, the projection pieces 34 come off the shafts 27. That is, the discharge tray 21 comes off the top cover 11. A degree of the load required for removing the discharge tray 21 from the top cover 11 is decided in view of strengths of the shafts 27 and the discharge tray 21. It is undesirable that the shafts 27 and the discharge tray 21 are damaged by the weight of the retained documents G or the external impact. It is preferable that the discharge tray 21 comes off the top cover 11 in the case where the load damaging the shafts 27 and/or the discharge tray 21 is applied thereto.

As shown in FIGS. 4 and 8, the discharge tray 21 is elastically deformed in some cases even when the discharge tray 21 is in the bending posture. For instance, as shown in FIG. 2, the top cover 11 is opened in such a fashion as to rotate upward from the intermediate frame 12. The opening and closing of the top cover 11 are performed by the user. The user opens or closes the top cover 11 by holding a part of the top cover 11 which is a leading edge of the rotation, i.e. the front face side of the top cover 11. In the case of opening the top cover 11, the user holds the front face side of the top cover 11. In this case, the discharge tray 21 in the bending posture is held integrally with the top cover 11. In the case of closing the top cover 11, the user pushes the discharge tray 21 in the bending posture downward from above. In order to close the top cover 11 tightly, the discharge tray 21 is pushed further downward. The discharge tray 21 in the bending posture is subject to the load applied by the user when the top cover 11 is opened or closed, for example. However, since the discharge tray 21 is bent onto the top cover 11, the discharge tray 21 contacts the top cover 11 when it is elastically deformed. When the discharge tray 21 contacts the top cover 11, the load onto the discharge tray 21 is transmitted to the top cover 11. It is unlikely that an excessive load is applied only on the discharge tray 21 in the bending posture. In other words, the bearings 29 of the discharge tray 21 and the shafts 27 of the top cover 11 are not damaged due to the external force applied on the discharge tray 21 in the bending posture. It is not preferable that the discharge tray 21 comes off the top cover 11 when the discharge tray 21 and the shafts 27 are not at the risk of being damaged.

When the main tray 28 of the discharge tray 21 in the bending posture is elastically deformed by the user to approach the top cover 11, the projection pieces 34 of the bearings 29 move toward the front ends of the shafts 27. When the projection pieces 34 move toward the front ends of the shafts 27, the locking ribs 36 are locked by the stoppers 37 as shown in FIGS. 4 and 8. With the locking ribs 36 being locked, the projection pieces 34 of the bearings 29 are restrained from moving toward the front ends of the shafts 27 further from the stoppers 37 even when the discharge tray 21 in the bending posture is elastically deformed. Since the projection pieces 34 do not reach the front ends of the shafts 27, the discharge tray 21 does not come off the top cover 11.

In addition, it is not always necessary to form the locking rib 36 on each of the projection pieces 34 of the bearings 29 formed at the ends the discharge tray. One locking lib 36 may be formed on one of the projection pieces 34 of the bearings 29. So far as the locking rib 36 is formed on one of the bearings 29, at least the bearing 29 on which the locking rib 36 is formed is not removed from the shaft 27 when the discharge tray 21 is in the bending posture. That is, the discharge tray 21 is not removed completely from the top cover 11.

As described in the foregoing, in the case where the load by documents G or the load by impact which is larger than a predetermined degree is applied on the discharge tray 21 in the retention posture, the bearings 29 travel the distance which is longer than a length of the shafts 27 so that the discharge tray 21 comes off the top cover 11. Since the discharge tray 21 can come off the top cover 11, damages of the bearings 29 and the shafts 27 are prevented when a load which is larger than a bearing force of the discharge tray 21 is applied on the discharge tray 21. It is possible to attach the discharge tray 21 to the top cover 11 after the discharge tray 21 has been removed from the top cover 11 without any damages on the shafts 27 and the bearings 29. In the case where the discharge tray 21 is in the bending posture, the stoppers 37 lock the locking ribs 36 to restrain the projection pieces 34 of the bearings 29 from reaching the front ends of the shafts 27. The discharge tray 21 is prevented from coming off the top cover 11 because of the restraint on movement of the bearings 29.

Figure 9:
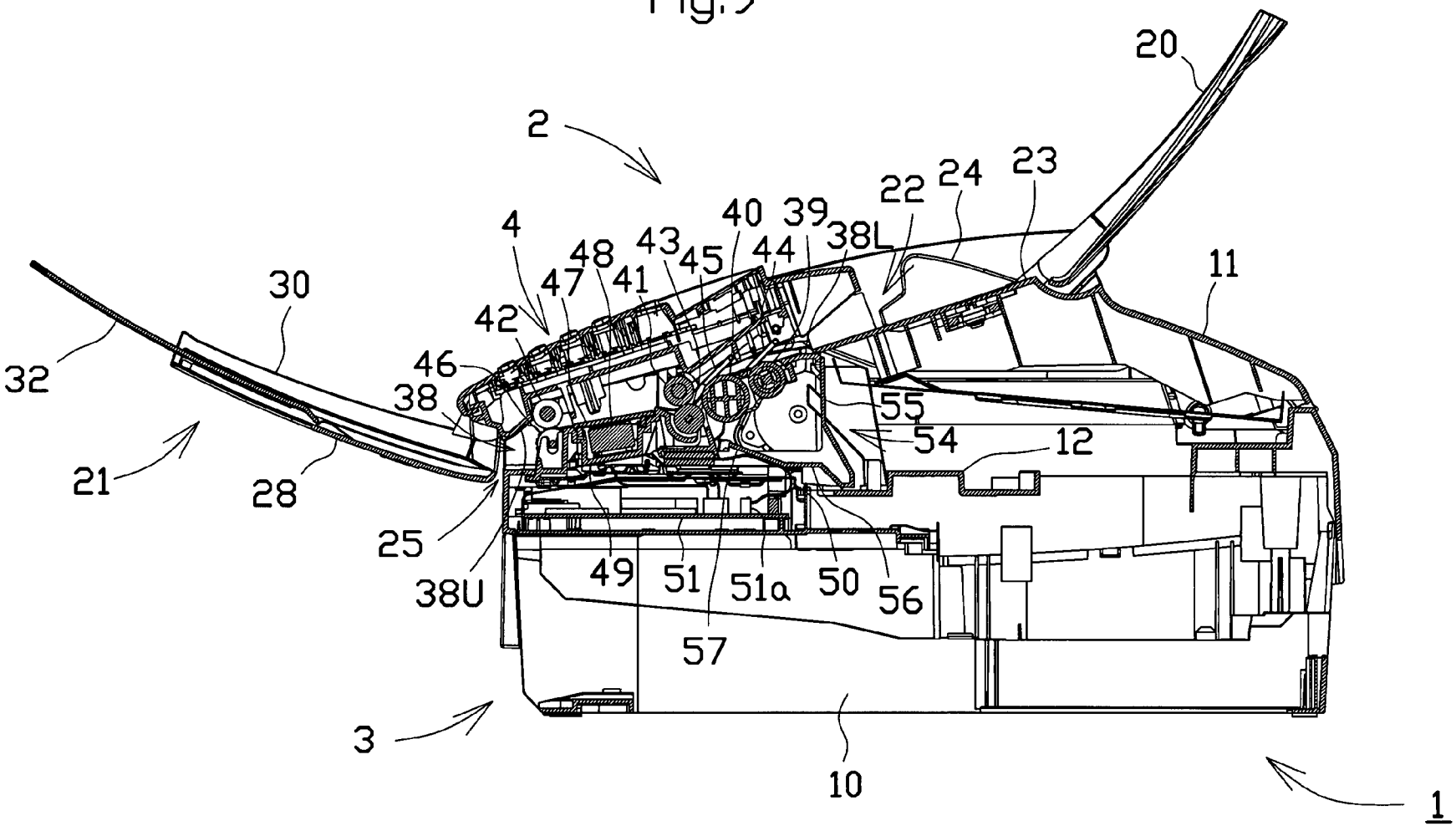
FIG. 9 is a diagram showing a II-II of FIG. 3.

As shown in FIG. 9, the transport path 38 is formed continuously from the document chute 22 to the discharge outlet 25. The transport path 38 is a passage formed between an undersurface of the top cover 11 and a top face of the intermediate frame 12. The undersurface of the top cover 11 forms an upper guide face 38U of the transport path 38. The top face of the intermediate frame 12 forms a lower guide face 38L of the transport path 38.

Figure 10:
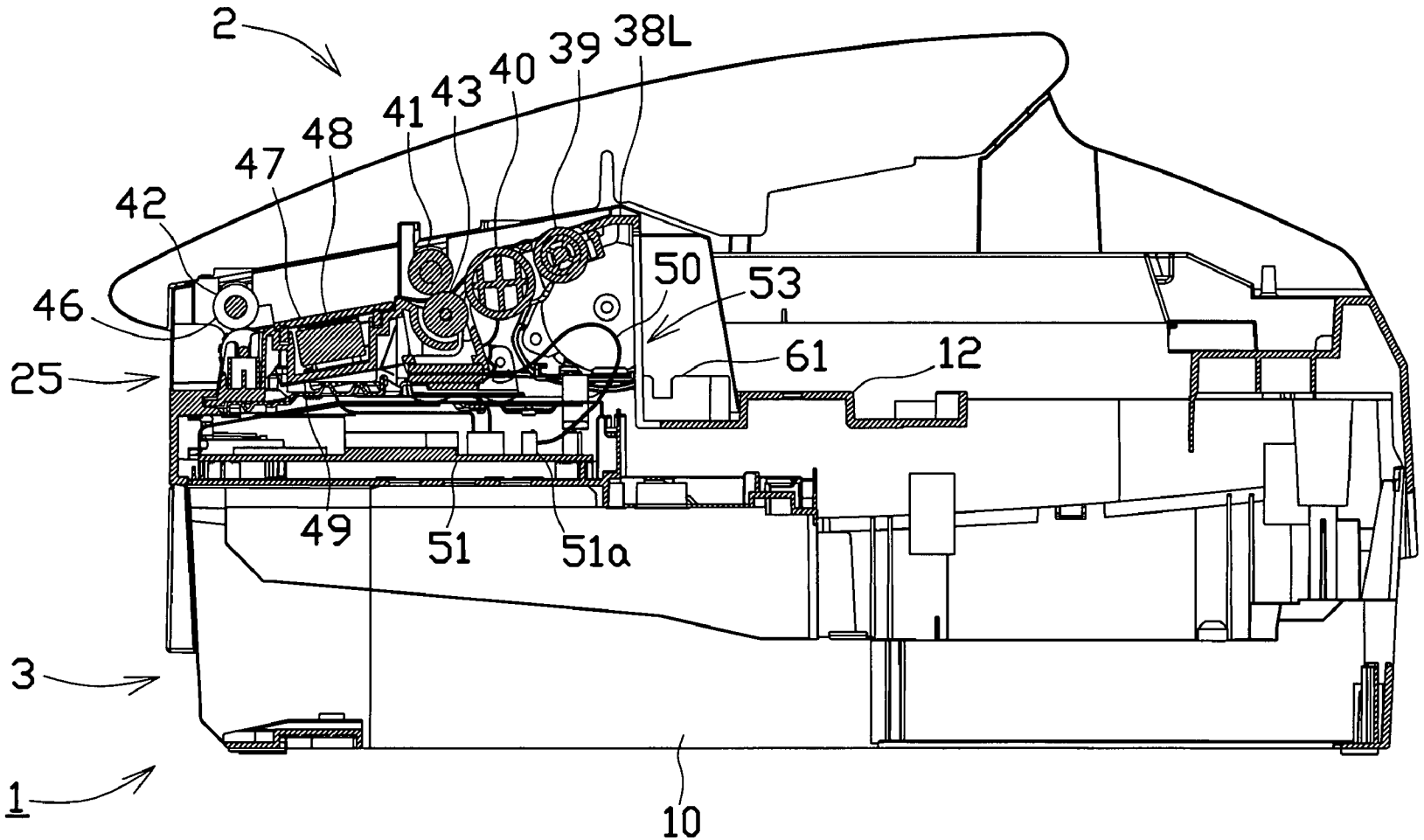
FIG. 10 is an enlarged view of a portion in the vicinity of an intermediate frame 12 shown in FIG. 9.

As shown in FIGS. 2, 9, and 10, the transport path 38 has a transport mechanism for transporting a document from the document chute 22 to the discharge outlet 25. More specifically, the transport mechanism is provided with a suction roller 39, a separation roller 40, a feed roller 41, a discharge roller 42, pinch rollers 43 and 46, and a driving mechanism such as a motor and a gear for driving the rollers. Note that the top cover 11, the document guide 20, and the discharge tray 21 are omitted in FIG. 10 for brevity of illustration.

The suction roller 39 is positioned most upstream on the transport path 38. A part of a roller surface of the suction roller 39 is exposed from the lower guide face 38L forming the intermediate frame 12. The suction roller 39 rotates upon reception of a drive transmission. The suction roller 39 is provided with a one lap clutch in a drive transmission path. Because of the one lap clutch, the suction roller 39 is capable of idle running for one lap.

The separation roller 40 is disposed at a position adjacent to the suction roller 39 in a direction of the discharge outlet 25 of the transport path 38. A part of a roller surface of the separation roller 40 is exposed from the lower guide face 38L forming the intermediate frame 12. The separation roller 40 rotates upon reception of the drive transmission.

As shown in FIG. 9, a suction nip piece 44 is provided at a position opposed to the suction roller 39. The suction nip piece 44 is provided on the top cover 11 in such a fashion as to project from the undersurface of the top cover 11 and slides in directions departing from and approaching to the suction roller 39. The suction nip piece 44 is elastically biased downward by a spring member. In a state where the document is not nipped, the suction nip piece 44 is in pressure contact with the roller surface of the suction roller 39. The suction roller 39 runs idle when the document is inserted into the document chute 22. When the document is inserted further into the document chute 22, the document is nipped between the suction roller 39 and the suction nip piece 44. The thus-nipped document is in pressure contact with the roller surface of the suction roller 39. When the suction roller 39 is rotated with the document being in the pressure contact therewith, a rotational force of the suction roller 39 is transmitted to the document. The document receives the rotational force of the suction roller 39 to be transferred to the transport path 38.

A separation nip piece 45 is provided at a position opposed to the separation roller 40. The separation nip piece 45 is provided on the top cover 11 in such a fashion as to project from the undersurface of the top cover 11 and slides in directions departing from and approaching to the separation roller 40. The separation nip piece 45 is elastically biased downward by a spring member. In a state where the document is not nipped, the suction nip piece 45 is in pressure contact with the roller surface of the separation roller 40. The document inserted into the document chute 22 is in pressure contact with the separation roller 40. The separation roller 40 does not run idle. A document insertion limit of the document chute 22 is detected by this contact. The document transferred by the suction roller 39 is then nipped between the separation roller 40 and the separation nip piece 45. The thus-nipped document is in pressure contact with the roller surface of the separation roller 40. When the separation roller 40 is rotated with the document being in the pressure contact therewith, a rotational force of the separation roller 40 is transmitted to the document. The document receives the rotational force of the separation roller 40 to be transferred to the transport path 38.

The feed roller 41 is disposed at a position adjacent to the separation roller 40 in a direction of the discharge outlet 25 of the transport path 38. The feed roller 41 is disposed on the top cover 11 in such a fashion as to expose its roller surface from the undersurface of the top cover 11. The feed roller 41 rotates upon reception of the drive transmission.

The pinch roller 43 is provided at a position opposed to the feed roller 41. A part of the roller surface of the pinch roller 43 is exposed from the top face of the intermediate frame 12. The pinch roller 43 has its shaft elastically biased by a spring piece. Due to the elastic biasing, the pinch roller 43 is in pressure contact with the roller surface of the feed roller 41. When the feed roller 41 is rotated, the pinch roller 43 is driven. The document transferred to the transport path 38 by the suction roller 39 and the separation roller 40 is then nipped between the feed roller 41 and the pinch roller 43. The thus-nipped document is in pressure contact with the roller surface of the feed roller 41. When the feed roller 41 is rotated with the document being in pressure contact therewith, a rotational force of the feed roller 41 is transmitted to the document. The document receives the rotational force to be transferred further downstream on the transport path 38.

The discharge roller 42 is disposed in the vicinity of the discharge outlet 25 of the transport path 38. The discharge roller 42 is disposed on the top cover 11 in such a fashion as to expose its roller surface from the undersurface of the top cover 11. The discharge roller 42 is rotated upon reception of the drive transmission.

The pinch roller 46 is provided at a position opposed to the discharge roller 42. A part of a roller surface of the pinch roller 46 is exposed from the top face of the intermediate frame 12. The pinch roller has its shaft elastically biased by a spring piece. Because of the elastic biasing, the pinch roller 46 is in pressure contact with the roller surface of the discharge roller 42. When the discharge roller 42 is rotated, the pinch roller 46 is driven. The document transferred by the feed roller 41 is then nipped between the discharge roller 42 and the pinch roller 46. The thus-nipped document is in pressure contact with the roller surface of the discharge roller 42. When the discharge roller 42 is rotated with the document being in pressure contact therewith, a rotational force of the discharge roller 42 is transmitted to the document. The document receives the rotational force to be discharged from the discharge outlet 25.

A platen glass 47 is disposed on the top face of the intermediate frame 12 at a position between the feed roller 41 and the discharge roller 42. The platen glass 47 forms a part of the lower guide face 38L of the transport path 38. The platen glass 47 is a transparent glass plate. A top face of the platen glass 47 is a document reading position.

An image sensor 48 is disposed under the platen glass 47. The intermediate frame 12 has a sensor holder unit 49 which is used for placing the image sensor 48 thereon and recessed under the platen glass 47. The holder unit 49 is provided with a support unit for supporting the platen glass 47, a boss unit for threadably mounting the components, a through-hole for electrical wiring, and the like; however, detailed description for them are omitted since they are designed depending on the embodiment of the intermediate frame 12.

The image sensors 48 are contact image sensor (CIS). The image sensor 48 emits light using a light source such as an LED on the document through the platen glass 47. Light reflected from the document is converged on light receiving elements by a lens of the image sensor 48. The light receiving elements convert intensity of the reflected light into electric signals. The light receiving elements of the image sensor 48 are arranged in a line in a direction orthogonal to the transport direction of the transport path 38. The direction orthogonal to the transport direction is the width direction of the multifunction device 1. The light source and the lens of the image sensor 48 are also arranged in a line in the same direction of the alignment of the light receiving elements. The image sensor 48 may be selected arbitrarily from one that reads monochrome images and one that reads color images.

The document transferred on the transport path 38 by the feed roller 41 passes on the platen glass 47. When the document passes on the platen glass 47, the image sensor 48 reads an image of the document. The document image reading by the image sensor 48 is performed in a width direction of the document, i.e., the reading line (main scanning) is in the direction orthogonal to the transport direction. The document is transferred for a predetermined distance by the feed roller 41 so that the image sensor performs next document image reading. Document image reading of the overall document is performed by repeating this operation from a leading edge to a rear edge of the document.

The image sensor 48 is mounted on the sensor holder unit 49 of the intermediate frame 12. An electric cable 50 is connected to the image sensor 48 for the purposes of power supply for lighting the light source and receiving electric signals output from the light receiving elements and the like. The electric cable 50 is used for electrically connecting the image sensor 48 to a control substrate 51. The electric cable 50 is formed of a plurality of conductors which are arranged in a line, and the conductors are coated with an insulating material for insulating coating. An overall shape of the electric cable 50 is a flat film-like. The electric cable 50 has a flexibility. Such electric cable 50 is generally referred to as a flat cable. The control substrate 51 is disposed below the image sensor 48. The control substrate 51 forms the controller for controlling the operation of the scanner unit 2. The electric cable 50 is connected to a connector 51*a* of the control substrate 51.

Figure 11:
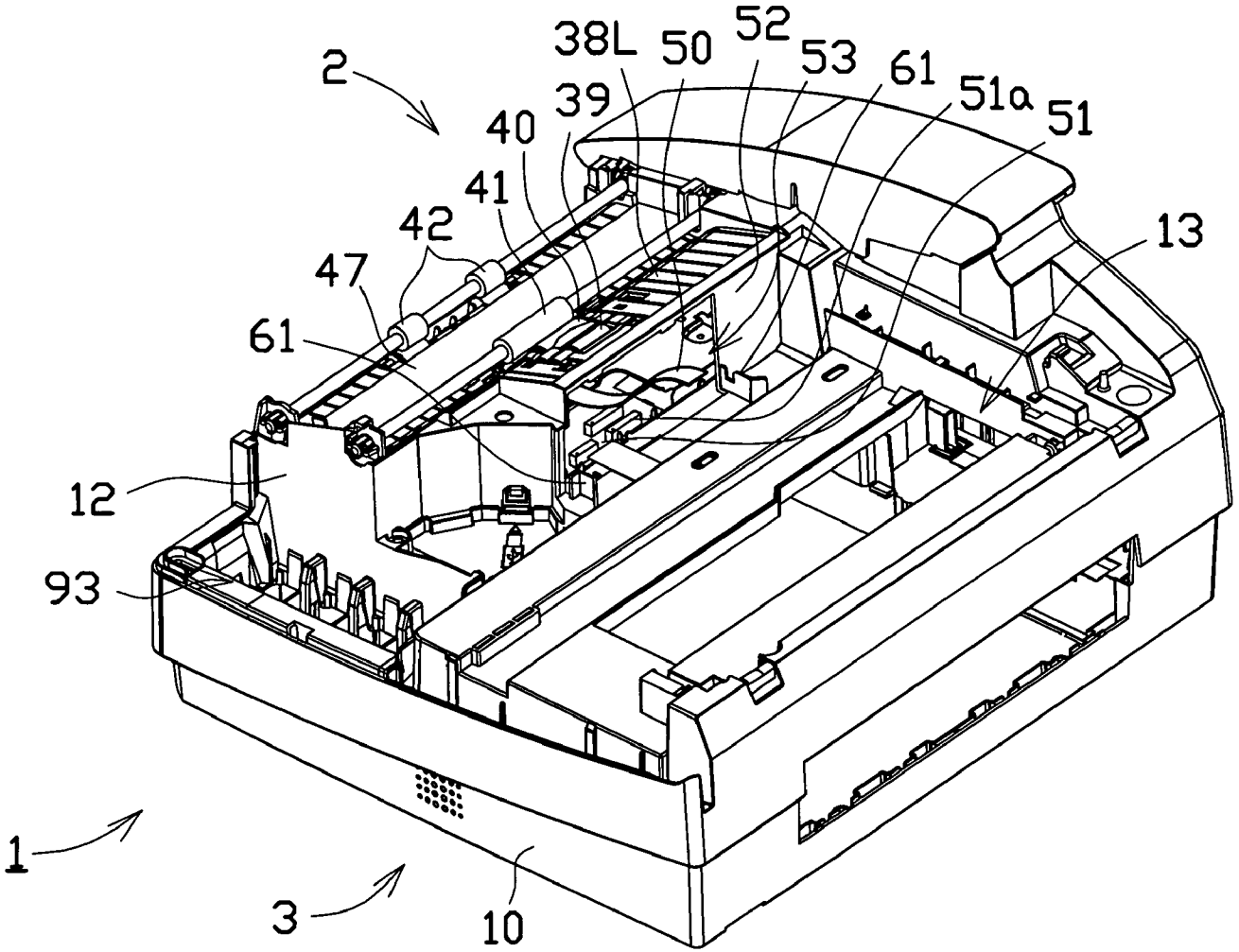
FIG. 11 is a perspective view showing a rear part of the multifunction device 1 when the top cover 11 is removed.

As shown in FIGS. 10 and 11, a wall 52 is formed on the intermediate frame 12 at a position most upstream of the lower guide face 38L of the transport path. An upper end of the wall 52 is continuous to the lower guide face 38L. A lower end of the wall 52 is positioned above the printer unit 3 and reaches to the vicinity of the control substrate 51. A space is formed at a position which is above the main frame 10 and in the interior portion of the intermediate frame 12 by the lower guide face 38L and the wall 52 of the intermediate frame 12. The control substrate 51 is disposed in the space.

An opening 53 is formed on the wall 52. The opening 53 is formed for the purpose of assembling the multifunction device 1. The assembly is principally the connection of the electric cable 50 connected to the image sensor 48 to the control substrate 51. As described in the foregoing, the image sensor 48 is mounted on the sensor holder unit 49 of the intermediate frame 12. The mounting of the image sensor 48 on the intermediate frame 12 is performed before mounting the intermediate frame 12 on the main frame 10. One end of the electric cable 50 is connected to the image sensor 48 when the image sensor 48 is mounted on the intermediate frame 12. The intermediate frame 12 on which the image sensor 48 and other components have been mounted is mounted on the main frame 10.

The control substrate 51 is provided near the main frame 10. In other words, the control substrate 51 is not mounted on the intermediate frame 12. The electric cable 50 electrically connecting the image sensor 48 to the control substrate 51 is connected to the connector 51*a* of the control substrate 51 after the intermediate frame 12 has been mounted on the main frame 10.

The electric cable 50 connected to the image sensor 48 is at a position inside the intermediate frame 12. The intermediate frame 12 covers the control substrate 51 above the control substrate 51. In order to connect the electric cable 50 to the connector 51*a* of the control substrate 51 after mounting the intermediate frame 12 on the main frame 10, it is necessary to form an opening on the intermediate frame 12. The opening 53 is equivalent to such opening. The opening 53 has such size that a hand of a worker can pass therethrough to reach the control substrate 51.

Figure 12:
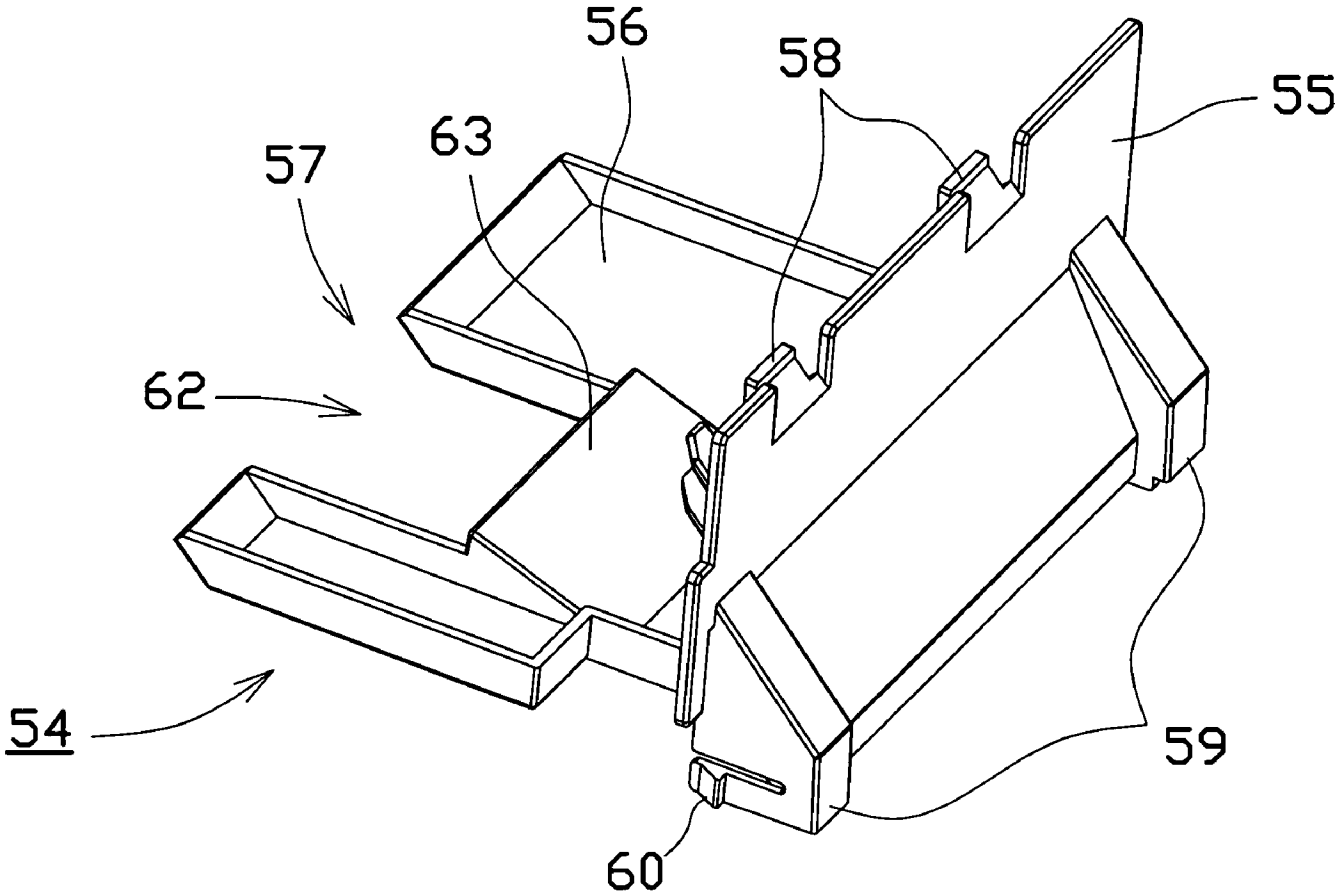
FIG. 12 is a perspective view showing a cover 54.

The opening 53 is sealed with a cover 54 after being used for the connection of the electric cable 50. As shown in FIG. 12, the cover 54 has a lid member 55, a tray 56, and a guide member 57. The opening 53 is sealed with the lid member 55. A fitting piece 58 to be fitted to a periphery of the opening 53 is formed on an upper end of the lid member 55. A grip member 59 evaginated in a direction toward the outside of the intermediate frame 12 is formed at a lower end of the lid member 55. Engagement members 60 capable of elastic deformation are formed on each of sidefaces of the grip member 59. The engagement members 60 are generally referred to as a snap fit. The cover 54 is fixed to the opening 53 when the fitting piece 58 is fitted to the periphery of the opening 53 and the engagement members 60 are engaged with receivers 61 formed on the periphery of the opening 53. The lid member 55 of the cover 54 fixed to the opening 53 seals the opening 53. The grip member 59 of the cover 54 is held by the worker when the worker fixes the cover 54 to the opening 53. By pushing the engagement members 60 in a direction toward the inside, the engagement of the engagement members 60 with the receivers 61 is released to enable the cover 54 to be removed from the opening 53. That is, the cover 54 is attachable to and detachable from the opening 53.

The tray 56 is formed in such a fashion as to project from the lid member 53 toward the inside of the intermediate frame 12. The tray 56 is in the shape of a tray, and a periphery of the tray 56 projects upward. A top face of the tray 56 is capable of retaining contaminants such as paper dust, eraser grits, and small objects. As shown in FIG. 9, the tray 56 projects above the control substrate 51 when the cover 55 is attached to the opening 53. The tray 56 covers the control substrate 51 above the control substrate 51.

The tray 56 is not necessarily cover the control substrate 51 thoroughly. The control substrate 51 may be covered with another member. However, as described in the foregoing, a region in the vicinity of the connector 51*a* of the control substrate 51 is exposed through the opening 53 in order to connect the electric cable 50 to the connector 51*a*. The exposed region of the connector 51*a* is covered with the tray 56.

The lower guide face 38L of the intermediate frame 12 exists above the tray 56. The lower guide face 38L is provided with the suction roller 39 and the separation roller 40. The roller surfaces of the suction roller 39 and the separation roller 40 are exposed in a direction of the control substrate 51. In order to expose a part of each of the roller surfaces of the suction roller 39 and the separation roller 40 from the lower guide face 38L of the intermediate frame 12, through-holes are formed on the lower guide face 38L. Through-holes may be formed in order to fix bearings of the suction roller 39 and the separation roller 40 in some cases. Through-holes may be formed due to the molding of the intermediate frame 12 in other cases. That is, the through-holes are formed on the lower guide face 38L of the intermediate frame 12 not only for the suction roller 39 and the separation roller 40 but also for various other purposes.

Contaminants can enter the intermediate frame 12 through the through-holes formed on the lower guide face 38L. Representative examples of the contaminants include paper dust of document, eraser grits adhered to document, small object such as a paperclip, and the like. The contaminants are undesirable. There is concern that electrical failure can be caused by the contaminants fallen on the control substrate 51. The contaminants entered the intermediate frame 12 from the lower guide face 38L fall onto the tray 56. The contaminants are prevented from falling onto the control substrate 51 since the tray 56 receives the contaminants.

As shown in FIG. 12, the guide member 57 is formed integrally with the tray 56. More specifically, the guide member 57 has a notch 62 and a slope 63. The notch 62 is formed by notching a part of the tray 56 by a predetermined width extending from a front end to the lid member 55. The notch 62 is so formed as to match the position of the electric cable 50 connected to the connector 51*a*. The width of the notch 62 is so set as to be a little wider than a width of the electric cable 50. The slope 63 is formed at the rear of the notch 62. The slope 63 slopes downward from its front end to the lid member 55.

The electric cable 50 has a length which is sufficient for being connected to the connector 51*a* of the control substrate 51 through the opening 53. That is, the electric cable 50 is long enough to vault when connected to the connector 51*a*. As described in the foregoing, the roller surfaces of the suction roller 39 and the separation roller 40 are exposed toward the direction of the control substrate 51. When the electric cable 50 contacts the suction roller 39 or the separation roller 40, the electric cable 50 can be damaged or entangled in the suction roller 39 or the separation roller 40 by the friction. In order to prevent the above troubles, the guide member 57 locates the electric cable beneath itself.

The guide member 57 is inserted into the opening 53 together with the tray 56 when fixing the cover 54 to the opening 53. The guide member 57 inserted into the opening places the electric cable 50 inside a space of the notch 62. When the guide member 57 is inserted into the opening 53 to such a degree that the lid member 55 of the cover 54 seals the opening 53, the electric cable 50 placed at the notch 62 contacts the slope 63. The slope of an undersurface of the slope 63 enables the slope 63 to guide the electric cable 50 in such a manner as to slide the electric cable 50 into a space under the slope 63. Since the electric cable 50 is thus guided to be pressed by the guide member 57 from above, the electric cable 50 does not vault. That is, the electric cable 50 is placed below the guide member 57 without fail. Since the electric cable 50 is pressed by the guide member 57 from above, the electric cable 50 is prevented from contacting the suction roller 39 or the separation roller 40.

(Structure of Printer Unit 3)

As shown in FIG. 1, the lower part of the multifunction device 1 is the printer unit 3. An opening 70 is formed on a front face of the main frame 10. A paper feed unit 71 and a paper discharge unit 72 are formed in a two-tiered fashion and exposed from the opening. The paper feed unit 71 is used for storing recording papers which are recording mediums. The paper feed unit 71 is a part of a feed tray and capable of being inserted into and drawn out of the opening 70. The paper feed unit 71 houses various sizes of recording papers such as A4 size papers, B5 size papers, and postcard size papers. A recording paper housed in the paper feed unit 71 is fed to an internal portion of the printer unit 3 so that a desired image is recorded thereon and then discharged to the paper discharge unit 72. Note that a state wherein the paper feed unit 71 has been drawn out of the opening 70 is shown in FIGS. 1 and 2.

Figure 13:
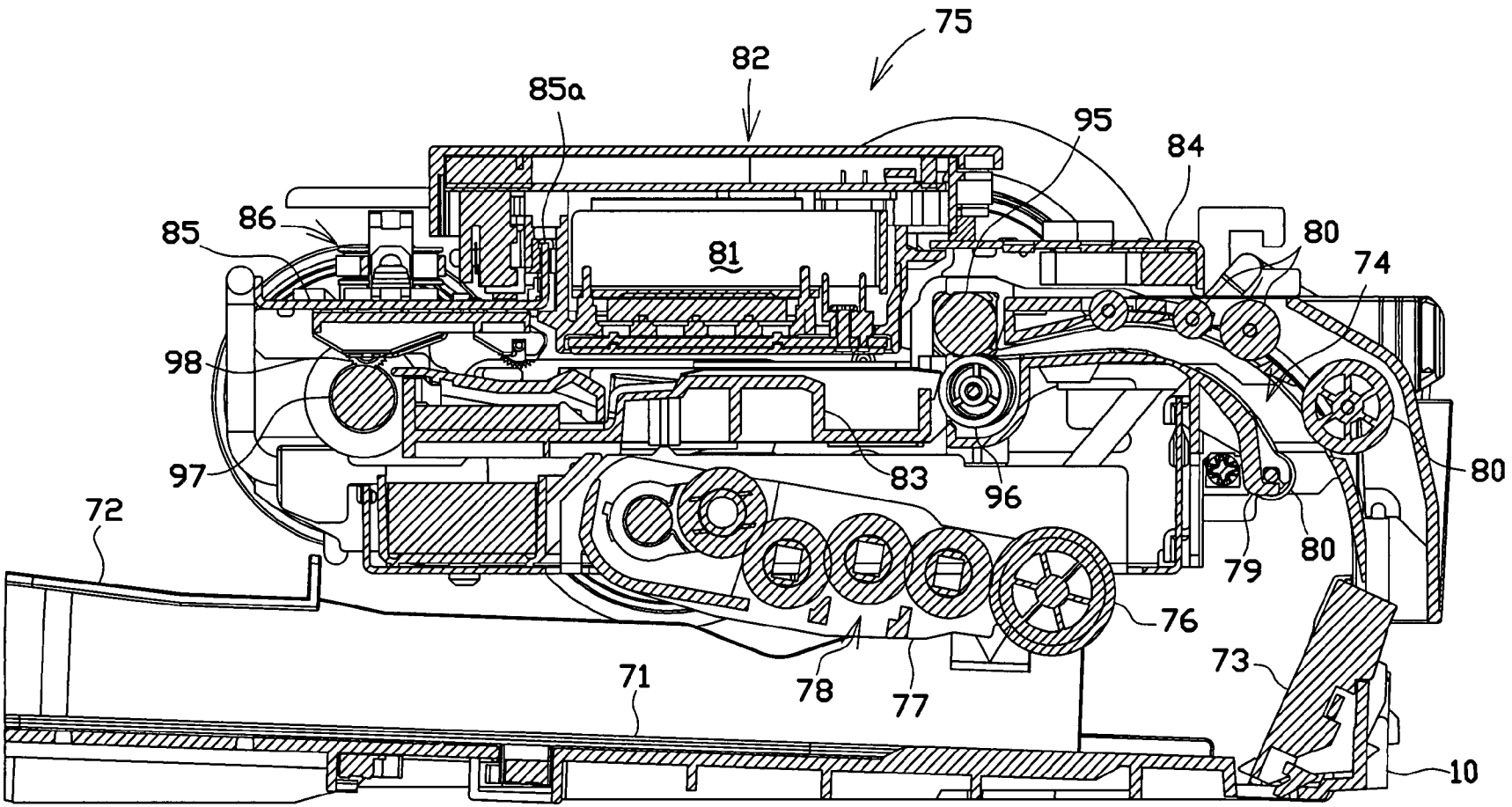
FIG. 13 is a sectional view showing an internal structure of a printer unit 3.

As shown in FIG. 13, the paper feed unit 71 is provided at the bottom of the main frame 10. A separation slope 73 for separating the recording papers piled in the paper feed unit 71 and guiding the separated sheet upward is disposed at the rear of the paper feed unit 71.

A feed path 74 of the printer unit 3 curves in such a fashion as to vault upwards from the separation slope 73 and extends in a direction from the rear face to the front face of the multifunction device 1. Further, the feed path 74 passes below an image recording unit 75 to reach the paper discharge unit 72. The recording paper housed in the paper feed unit 71 is transferred on the feed path 74. That is, the recording paper turns upwards in such a manner as to make a U-turn to reach the position below the image recording unit 75. The image recording unit 75 performs the image recording. After that, the recording paper is discharged to the paper discharge unit 72.

As shown in FIG. 13, a paper feed roller 76 is provided above the paper feed unit 71. The paper feed roller 76 separates the recording papers piled in the paper feed unit 71 to feed the recording papers one by one to the feed path 74. A paper feed arm 77 for moving the paper feed roller 76 upward and downward in such a manner that the paper feed roller 76 contacts and depart from the paper feed unit 71. The paper feed roller 76 is supported by a shaft at a front end of the paper feed arm 77. A driving of the motor is transmitted to the paper feed roller 76 by a drive transmission mechanism 78 formed of plural gears engaged with one another. The paper feed roller 76 is rotated upon reception of the drive transmission.

The paper feed arm 77 is disposed in such a fashion as to swing vertically about its rear end. The paper feed arm 77 is declined toward the paper feed unit 71 in a standby state. The paper feed arm 77 is swung upward interlockingly with the withdrawal of the paper feed unit 71. In the state where the paper feed arm 77 is declined, the paper feed roller 76 is brought into a pressure contact with a surface of the recording paper on the paper feed unit 71. The uppermost recording paper is fed to the separation slope 73 when the paper feed roller 76 rotates. The recording paper is guided as its leading edge contacts the separation slope 73 to be fed to the feed path 74. The subsequent recording paper (recording paper directly beneath the uppermost recording paper) may be fed together with the uppermost recording paper due to friction or static electricity in some cases. The subsequent recording paper is stopped when it contacts the separation slope 73.

The feed path 74 has an outer guide face and an inner guide face which are opposed to each other with a predetermined distance provided therebetween and disposed avoiding the image recording unit 75 and other components. For instance, the outer guide face is formed integrally with the main frame 10 on the feed path 74 which is at the rear of the main frame 10. The inner guide face is formed of a guide member 79. The guide member 79 is fixed to the main frame 10.

Feed rollers 80 are provided on the feed path 74, particularly at the curvature of the feed path 74. Each of the feed rollers 80 is disposed in such a fashion that a part thereof is exposed from the outer guide face or the inner guide face. The feed rollers 80 are capable of rotating in an axial direction which is a direction of a width of the feed path 74. Because of the feed rollers 80, the feeding of the recording papers which contact the guide faces at the curvature on the feed path 74 is performed smoothly.

The image recording unit 75 has a carriage 82 on which an ink jet recording head 81 is mounted, the carriage reciprocating in the main scanning direction. Inks of cyan (C), magenta (M), yellow (Y), and black (Bk) are supplied to the inkjet recording head 81 from ink cartridges 92 disposed independently from the inkjet recording head 81 through ink tubes 94. The inkjet recording head 81 ejects each of the supplied inks as fine ink droplets. The carriage 82 on which the inkjet recording head 81 is mounted is reciprocated in a direction orthogonal to the feed direction. During the reciprocation, the inks are ejected from the inkjet recording head 81 to perform image recording on the recording paper fed on a platen 83.

Figure 14:
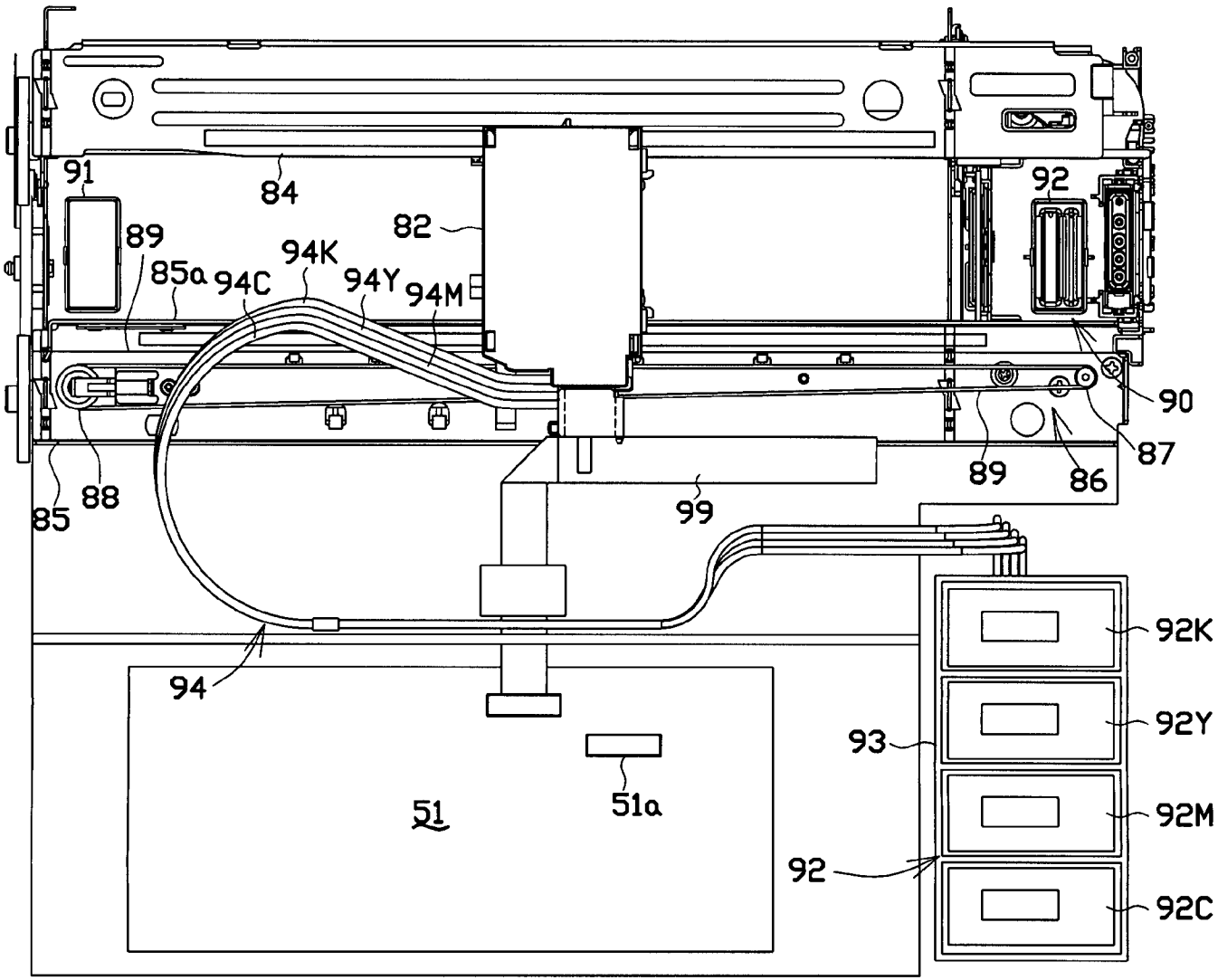
FIG. 14 is a plan view showing the internal structure of the printer unit 3.

As shown in FIG. 14, a pair of guide rails 84 and 85 is aligned above the feed path 74 in a direction in which the recording papers are fed and extended in the width direction of the feed path 74. Te carriage 82 is so provided as to straddle the guide rails 84 and 85. The carriage 82 is slidable on the guide rails 84 and 85 in the direction orthogonal to the paper feed direction. The guide rail 84 disposed upstream of in the paper feed direction has a length in the feed path width direction, which is wider than a movement range of the carriage 82, and is in the shape of a flat plate. An edge of the carriage 82 at the upstream side is slidably supported by the guide rail 84.

The guide rail 85 disposed downstream in the paper feed direction has a length in the feed path width direction, which is identical to the length of the guide rail 84, and is in the shape of a flat plate. A rim 85*a* of the guide rail 85 for supporting the carriage 82 is bent upwards at a substantially right angle. The carriage 82 is slidably supported by the guide rail 85. The rim 85*a* of the guide rail 85 is pinched by rollers of the carriage 82 and the like. That is, the carriage 82 is slidably supported on the guide rails 84 and 85 and reciprocates in the feed path width direction using the rim 85*a* of the guide rail 85 as a guide. A sliding member for reducing friction is provided at regions of the carriage contacting top faces of the guide rails 84 and 85 as required.

A belt driving mechanism 86 is provided on the top face of the guide rail 85. The belt driving mechanism 86 has a driving pulley 87, a driven pulley 88, and an close-ended circular timing belt 89 having blades on its inner side and hung over the driving pulley 87 and the driven pulley 88, one of the driving pulley 87 and the driven pulley 88 being disposed in the vicinity of one end of the width of the feed path 74 and the other one of the pulleys 87 and 88 being disposed in the vicinity of the other end of the width of the feed path 74. A driving force is input from the motor to a shaft of the driving pulley 87. The timing belt 89 revolves in accordance with the rotation of the driving pulley 87. The timing belt 89 may be an open-ended belt of which both ends are fixed to the carriage 82.

The carriage 82 is fixed to the timing belt 89. In accordance with the revolution of the timing belt 89, the carriage 82 reciprocates on the guide rails 84 and 85 with respect to the rim 85*a* of the guide rail 85. The inkjet recording head 81 is mounted on the carriage 82, so that the inkjet recording head 81 is capable of reciprocation in the feed path width direction which is a main scanning direction of the inkjet recording head 81. An encoder strip 89 of a linear encoder is provided along the rim 85*a* of the guide rail 85. The linear encoder detects the encoder strip 89 by photointerrupter. The reciprocation of the carriage 82 is controlled by detection signals of the linear encoder.

As shown in FIG. 13, the platen 83 is disposed at a position opposed to the inkjet recording head 81. The platen 83 is disposed over a central portion of the reciprocation range of the carriage 82, and the recording papers pass on the central portion. A width of the platen 83 is sufficiently larger than a maximum width of the recording papers to be fed. That is, the recording papers are fed in such a manner that both ends of each of the recording papers are placed on the platen 83 without fail.

As shown in FIG. 14, a purge mechanism 90 and an ink discharge tray 91 are provided at regions avoiding the region on which the recording papers pass, i.e. avoiding the region in which the inkjet recording head 81 performs the image recording. The purge mechanism 90 and the ink discharge tray 91 are referred to as a maintenance unit. The purge mechanism 90 is used for suctioning bubbles and contaminants from nozzles of the inkjet recording head 81. The purge mechanism 90 has caps 92 for covering the nozzles of the inkjet recording head 81, a pump mechanism connected to the inkjet recording head 81 via the caps 92, and a transfer mechanism for attaching and detaching the caps 9 to and from nozzle surfaces of the inkjet recording head 81. In the case of suctioning the bubbles of the inkjet recording head 81, the carriage 82 is moved so as to locate the inkjet recording head 81 above the caps 92. The caps 92 move upward to the inkjet recording head 81 to be in close contact with the nozzles of the inkjet recording head 81. A pump connected to the caps 92 vacuums up the inks from the nozzles of the inkjet recording head 81. The bubbles and the like inside the nozzles are removed together with the inks.

The ink discharge tray 91 is used for receiving inks ejected from the inkjet recording head 81 for cleaning the nozzles. Such ink ejection is referred to as flashing. The ink discharge tray 91 is provided in the region of the reciprocation of the carriage 82 and avoiding the image recording region. The inkjet recording head 81 is moved to be located above the ink discharge tray 91 so that the inks are ejected toward the ink discharge tray 91 for the ink flashing. The bubbles in the nozzles and the like are removed by the ink flashing.

The ink cartridges 92 are mounted on the cartridge mounting unit 93 provided at the right hand side of the printer unit 3 as viewed from the front of the printer unit 3. The cartridge mounting unit 93 is disposed separately from the carriage 82 on which the inkjet recording head 81 is mounted. Ink tubes 94 are provided to connect the cartridge mounting unit 93 to the carriage 82. The inks are supplied from the ink cartridges 92 mounted on the cartridge mounting unit 93 to the carriage 82 via the ink tubes 94.

The ink cartridges 92 include an ink cartridge 92C storing the ink of cyan (C), an ink cartridge 92M storing the ink of magenta (M), an ink cartridge 92Y storing the ink of yellow (Y), and an ink cartridge 92K storing the ink of black (Bk). The ink cartridges 92C, 92M, 92Y, and 92K are mounted on the cartridge mounting unit 93 at predetermined positions. When the ink cartridges 92 are mounted on the cartridge mounting unit 93, ink needles prick the sealing members of the ink cartridges 92. Each of the ink needles is provided in the cartridge mounting unit 93 for the relevant one of the ink cartridges 92. The ink needles are hollow needles. Each of the inks flows out of the ink cartridge 92 from the ink needle. The flown inks pass through flow paths in the cartridge mounting unit 93 to be lead to the ink tubes 94.

Each of the inks of the ink cartridges 92C, 92M, 92Y, and 92K mounted on the cartridge mounting unit 93 is supplied to the inkjet recording head 81 via the relevant one of the ink tubes 94. Each of the ink tubes 94 is made from a synthetic resin and has flexibility for flexure in accordance with the scanning by the carriage 82.

The flow path of each of the ink cartridges 92 of the cartridge mounting unit 93 is connected to relevant one of the ink tubes 94C, 94M, 94Y, and 94K. The ink tube 94C is used for the ink cartridge 92C and supplies the ink of cyan (C). The ink tubes 94M, 94Y, and 94K are used for ink cartridges 92M, 92Y, and 92K and supply inks of magenta (M), yellow (Y), and black (Bk).

The ink tubes 94C, 94M, 94Y, and 94K led out from the cartridge mounting unit 93 are drawn to near the center along a direction of a width of the device to be fixed by an appropriate member of the main frame 10. A part of each of the ink tubes 94C, 94M, 94Y, and 94K extending from the fixture position to the carriage 82 is not fixed to the main frame 10. The non-fixed part changes in posture in accordance with the reciprocation of the carriage 82. That is, when the carriage 82 moves to one end (left hand side in FIG. 14) of the reciprocation, each of the ink tubes 94C, 94M, 94Y, and 94K bends in such a manner that a bending radius of a bend portion of a U-shape is reduced to move toward the direction of movement of the carriage 82. In accordance with a movement of the carriage 82 to the other end (right hand side in FIG. 14) of the reciprocation, each of the ink tubes 94C, 94M, 94Y, and 94K bends in such a manner that a bending radius of a bend portion is increased to move toward the direction of movement of the carriage 82.

Inkjet recording head 81 is used for ejecting inks of C, M, Y, and Bk from the nozzles. The nozzles for the plural colors are aligned at a predetermined pitch. The number of the nozzles and the pitch are set in view of resolution of an image to be recorded and the like. Each of the inks is ejected in a predetermined amount from the relevant nozzles as ink droplets by deformation of a piezoelectric element.

As shown in FIG. 13, a feed roller 95 and a pinch roller 96 disposed upstream of the image recording unit 75. The feed roller 95 receives the drive transmission from the motor to be rotated. A shaft of the pinch roller 96 is biased by a spring to bring the pinch roller 96 in pressure contact with the feed roller 95. The recording paper being fed on the feed path 74 is pinched between the feed roller 95 and the pinch roller 96. The recording paper is brought into pressure contact with the feed roller 95 and fed by the rotation of the feed roller 95.

A paper discharge roller 97 and a spur roller 98 are disposed downstream of the image recording unit 75. The paper discharge roller 97 receives the drive transmission from the motor to be rotated. A shaft of the spur roller 98 is biased by a spring to bring the spur roller 98 in pressure contact with the paper discharge roller 97. A roller surface of the spur roller 98 has a tread like that of an ordinary spur. The recording paper after recording is pinched between the paper discharge roller 97 and the spur roller 98. The recording paper after recording is brought into pressure contact with the paper discharge roller 97 to be discharged by the rotation of the paper discharge roller 97. The tread of the spur roller 98 is formed for the purpose of preventing deterioration of images recorded on the recording paper.

As shown in FIG. 14, the control substrate 51 is disposed on the front face of the main frame 10. The controller of the scanner unit 2 and the controller of the printer unit 3 are formed of the control substrate 51. As described in the foregoing, the control substrate 51 and the image sensor 48 are electrically connected to each other by the electric cable 50. Likewise, the control substrate 51 is electrically connected to the inkjet recording head 81 by an electric cable 99. The electric cable 99 is led out from the carriage 82 to the reciprocation direction and bent vertically to be in a substantially U-shape. Since the substantially U-shaped portion is not fixed by any other components, the portion changes its posture in accordance with the reciprocation of the carriage 81.

The control substrate 51 is provided on the main frame 10. The intermediate frame 12 is mounted in such a fashion as to cover the main frame 10 above the main frame 10. The image sensor 48 is mounted on the intermediate frame 12. The electric cable 50 electrically connecting the image sensor 48 to the control substrate 51 is connected to the connector 51*a* of the control substrate 51 after the intermediate frame 12 has been mounted on the main frame 10.

This invention may be embodied in other specific forms without departing from the spirit or essential characteristics thereof. The present embodiment is therefore to be considered in all respects as illustrative and not restrictive, the scope of this invention being indicated by the appended claims rather than by foregoing description and all changes which come within the meaning and range of equivalency of the claims are therefore intended to be embraced therein.

What is claimed is:

1. A sheet transport device comprising:

a sheet tray on which a sheet to be transferred is placed;

a device main body provided with a transport path led from the sheet tray to a discharge outlet;

a transport mechanism for transporting the sheet from the sheet tray to the discharge outlet via the transport path;

shafts projecting from positions in the vicinity of opposite ends of the discharge outlet of the device main body to horizontal directions opposite to each other;

a discharge tray having a main tray which retains the discharged sheet and is provided with bearings for the shafts, the discharge tray being capable of changing its posture between a bending posture for bending the main tray toward the device main body when the bearings are fitted to the shafts and a retention posture for retaining the sheet discharged from the discharge outlet with the main tray being projected from the device main body as well as being capable of elastic deformation so as to move the bearings toward front ends of the shafts; and locking members provided in the vicinity of the shafts of the device main body in such a fashion as to restrain the bearings of the discharge tray in the bending posture from moving toward the front ends of the shafts by locking the bearings and as to allow the bearings of the discharge tray in the retention posture to move toward the front ends of the shafts.

2. The sheet transport device according to claim 1, wherein each of the shafts is reduced in diameter to its front end in a tapered fashion.

3. The sheet transport device according to claim 1, wherein the discharge tray retains the sheet on a top face of the main tray when the discharge tray is in the retention posture, and each of the bearings is provided with a projection piece projecting in a direction upward from the top face of the main tray and having a shaft hole.

4. The sheet transport device according to claim 3, wherein each of the locking members projects in a direction approaching to the shaft at a position closer to the front end of the shaft than to the bearing fitted to the shaft and is provided with a locking rib extending in such a fashion that an outer rim thereof is situated outside an edge of the locking member in a radial direction of the shaft when the discharge tray is in the bending posture and that the outer rim is situated inside the edge of the locking member in the radial direction of the shaft when the discharge tray is in the retention posture.

5. The sheet transport device according to claim 4, wherein the locking rib is formed on one of the bearings of the discharge tray.

6. The sheet transport device according to claim 1, wherein the discharge tray projects in a horizontal direction from a position in the vicinity of the discharge outlet of the device main body in the retention posture.

7. The sheet transport device according to claim 1, wherein the discharge tray covers an operation panel provided on the device main body in the bending posture.

8. The sheet transport device according to claim 7, wherein the operation panel is provided with a liquid crystal display unit, and the discharge tray is provided with a window for making the liquid crystal display unit visible when the discharge tray is in the bending posture.

9. The sheet transport device according to claim 8, wherein the window of the discharge tray is provided with a transparent member.

10. The sheet transport device according to claim 1, wherein the discharge tray is provided with an extension tray capable of moving in and out of the main tray and capable of changing its posture between an extension posture for projecting from an end of the main tray and a housing posture for being housed in the main tray.

* * * * *